United States Patent [19]

Timson

[11] 3,960,557

[45] *June 1, 1976

[54] POLYDISPERSED SILVER HALIDE EMULSIONS WITH IODIDE FOR USE IN DIFFUSION TRANSFER

[75] Inventor: William J. Timson, Belmont, Mass.

[73] Assignee: Polaroid Corporation, Cambridge, Mass.

[ * ] Notice: The portion of the term of this patent subsequent to Oct. 10, 1989, has been disclaimed.

[22] Filed: Nov. 3, 1972

[21] Appl. No.: 303,474

[52] U.S. Cl. ..... 96/3; 96/29 D; 96/77; 96/94 R

[51] Int. Cl.[2] ..... G03C 7/00; G03C 5/54; G03C 1/48; G03C 1/10

[58] Field of Search ..... 96/3, 77, 94 R, 29 D

[56] References Cited

UNITED STATES PATENTS

| | | | |
|---|---|---|---|
| 3,326,641 | 6/1967 | Audran et al. | 23/305 |
| 3,415,650 | 12/1968 | Frame et al. | 96/94 |
| 3,498,454 | 3/1970 | Timson | 209/144 |
| 3,697,271 | 10/1972 | Timson | 96/3 |

*Primary Examiner*—David Klein
*Assistant Examiner*—Richard L. Schilling
*Attorney, Agent, or Firm*—Gerald L. Smith; Robert M. Ford

[57] ABSTRACT

The present invention relates to photography and, more particularly, to diffusion transfer process photographic film units which comprise a photosensitive element adapted to provide, by diffusion transfer photographic processing, selective dye image recordation of incident actinic radiation as a function of the point-to-point degree of photosensitive element exposure, which film unit includes a plurality of essential layers including a polydisperse silver halide photosensitive emulsion layer comprising a particulate dispersion of photosensitive silver iodobromide, iodochloride or iodochlorobromide crystals possessing a mean iodide concentration within the range of about 0.5 to 15 mole % and in which not in excess of about 20%, by weight, of the crystals deviate from the selected mean iodide concentration by in excess of about ±25%, by weight, of iodide, having associated therewith dye image-forming material which is diffusible during processing as a function of the point-to-point degree of silver halide layer exposure to incident actinic radiation and a layer adapted to receive dye image-forming material diffusing thereto; and to specified diffusion transfer processes employing such film units.

25 Claims, 9 Drawing Figures

POLYDISPERSED SILVER HALIDE EMULSIONS WITH IODIDE FOR USE IN DIFFUSION TRANSFER

BACKGROUND OF THE INVENTION

1. Field of the Invention

The present invention is directed to providing new and improved diffusion transfer process photographic film units adapted to provide, as a function of the point-to-point degree of photoexposure, by diffusion transfer processing a dye transfer image.

2. Description of Prior Art

As disclosed in U.S. Pat. No. 3,672,890 a composite photosensitive structure, particularly adapted for reflection type photographic diffusion transfer color process employment, which comprises a plurality of essential layers including, in sequence, a dimensionally stable layer preferably opaque to incident radiation; one or more silver halide emulsion layers having associated therewith a diffusion transfer process dye image-providing material; a polymeric layer adapted to receive solubilized dye image-providing material diffusing thereto; and a dimensionally stable transparent layer, may be exposed to incident actinic radiation and processed by interposing, intermediate the silver halide emulsion layer and the reception layer, a processing composition and an opacifying agent, which may reflect incident radiation, in a quantity sufficient to mask dye image-providing material associated with the silver halide emulsion.

In a preferred embodiment, the composite photosensitive structure includes a rupturable container, retaining an alkaline processing composition and the opacifying agent, fixedly positioned extending transverse a leading edge of the composite structure in order to effect, upon application of compressive pressure to the container, discharge of the processing composition intermediate the opposed surfaces of the reception layer and the next adjacent silver halide emulsion.

The liquid processing composition, distributed intermediate the reception layer and the silver halide emulsion, permeates the silver halide emulsion layers of the composite photosensitive structure to initiate development of the latent images contained therein resultant from photoexposure. As a consequence of the development of the latent images, dye image-providing material associated with each of the respective silver halide emulsion layers is individually mobilized as a function of the point-to-point degree of the respective silver halide emulsion layer's photoexposure, resulting in imagewise distributions of mobile dye image-providing materials adapted to transfer, by diffusion, to the reception layer to provide the desired transfer dye image. Subsequent to substantial dye image formation in the reception layer, means associated with composite structure are adapted to convert the pH of the film unit from a first processing pH at which dye image-providing material is diffusible as a function of the film unit's photoexposure to a second pH at which the transfer dye image exhibits increased stability, preferably a sufficient portion of the ions of an alkaline processing composition transfers, by diffusion, to a polymeric neutralizing layer to effect reduction in the alkalinity of the composite film unit from a first alkaline processing pH to the second ph at which dye image-providing material is substantially nondiffusible, and further dye image-providing material transfer is thereby substantially obviated.

The transfer dye image is viewed, as a reflection image, through the dimensionally stable transparent layer against the background provided by the opacifying agent, distributed as a component of the processing composition, intermediate the reception layer and next adjacent silver halide emulsion layer. The thus-formed opacifying stratum effectively masks residual dye image-providing material retained in association with the silver halide emulsion layer subsequent to processing.

In U.S. Pat. No. 3,415,644, the dimensionally stable layer of the film unit next adjacent the photosensitive layer or layers is disclosed to be opaque, the opacifying agent is initially disposed in an aqueous alkaline processing composition and the film unit's pH modulating means are disclosed to comprise a polymeric layer disposed intermediate the dimensionally stable transparent layer and the reception layer and adapted to reduce, subsequent to substantial dye transfer image formation, the pH of an aqueous alkaline processing composition from a first processing pH at which the dye image-forming material or materials are soluble and diffusible in the composition as a function of the photoexposure of the photosensitive silver halide layer associated therewith to a second pH at which the dye image-forming material or materials are substantially nondiffusible and, as disclosed in U.S. Pat. No. 3,415,646, the dimensionally stable layer of the film unit next adjacent the photosensitive silver halide layer or layers is disclosed to be transparent to incident actinic radiation and, as further disclosed in U.S. Pat. No. 3,415,645, in such instance the opacifying agent may be initially disposed in the film unit intermediate the reception layer and next adjacent silver halide layer.

As disclosed in U.S. Pat. Nos. 3,615,421 and 3,661,585, the opacifying component of the film unit may optionally be initially disposed as a preformed processing composition permeable layer, intermediate the reception layer and next adjacent silver halide layer, in a concentration which prior to photoexposure is insufficient to prevent transmission therethrough of exposing actinic radiation and which, subsequent to processing, possesses an opacifying capacity effective to mask residual dye image-providing material retained associated with the film unit's silver halide emulsion layers, and in U.S. Pat. No. 3,647,435, the opacifying component of the film unit may optionally be initially formed in situ, intermediate the reception layer and next adjacent silver halide layer, during photographic processing of the film unit.

In U.S. Pat. No. 3,647,437, the opacifying component is disclosed to optionally comprise a light-absorbing reagent such as a dye which is present as an absorbing species at the first pH and which may be converted to a substantially non-absorbing species at the second pH, and in U.S. Pat. Nos. 3,473,925; 3,573,042 and 3,576,626, opacifying and reflecting component, respectively, may be individually interposed intermediate the silver halide layer and reception layer by selective distribution from a composite or a plurality of rupturable containers.

In U.S. Pat. No. 3,573,043, the polymeric neutralizing layer is disclosed to be optionally disposed intermediate the dimensionally stable opaque layer and next adjacent essential layer, i.e., next adjacent silver halide/dye image-providing material component, to effect the designated modulation of film unit's environmental pH; U.S. Pat. No. 3,576,625 discloses the employment of particulate acid distributed within the film unit to effect the modulation of the environmental pH, and U.S. Pat. No. 3,573,044 discloses the employment of processing composition solvent vapor transmissive dimensionally stable layers to effect process modulation of dye transfer as a function of solvent concentration.

Where desired, the film unit may also be constructed in accordance with the disclosure of U.S. Pat. Nos. 3,594,164; 3,594,165; 3,689,262, and 3,689,262, to comprise a composite photosensitive structure including a transparent dimensionally stable layer carrying a reception layer, a processing composition permeable opaque layer and a photosensitive silver halide layer and the film unit may include a separate dimensionally stable sheet element adapted to be superposed on the surface of the photosensitive structure opposite the dimensionally stable layer and may further include means such as a rupturable container retaining processing composition for distribution of a processing composition intermediate the sheet and photosensitive structure to effect processing. As further disclosed in certain of the last-cited patents and applications, in structures wherein the receptor is positioned next adjacent the transparent layer or the processing composition and/or the sheet is to be separated from the remainder of the film unit subsequent to processing, the latter elements may optionally include opacifying component.

As disclosed in U.S. Pat. No. 3,620,724, the dimensionally stable layer referred to may be opaque and in which instance the photosensitive silver halide layer is positioned next adjacent the opaque support layer and the opacifying component of the film unit's processing composition permeable opaque layer will be disposed in the unit in a concentration insufficient to prevent transmission therethrough of exposing actinic radiation and which, subsequent to processing, possesses an opacifying capacity effective to mask residual dye image-providing material retained associated with the silver halide layer, and as disclosed in U.S. Pat. No. 3,647,434, the opacifying agent may be optionally formed in such film unit, in situ, during processing of the unit.

SUMMARY OF THE INVENTION

The present invention is directed to a new and improved, preferably integral negative/positive, diffusion transfer process photographic film unit adapted to provide, by diffusion transfer processing, photographic color image reproduction as a function of exposure of such film unit to incident actinic radiation.

The film unit assemblage construction to be employed in the practice of the present invention preferably comprises a film unit of the general type set forth in aforementioned U.S. Pat. Nos. 3,415,644, -5 and -6; 3,473,925; 3,573,042, -3 and -4; 3,576,625 and -6; 3,594,164 and -5; 3,615,421; 3,620,724; 3,647,434, -5 and -7; 3,661,585; 3,672,890; and 3,689,262; and copending U.S. patent application Ser. No. 159,254; and in U.S. Pat. Nos. 2,983,606 and 3,345,163; 3,778,265, and will include a polydisperse silver halide layer which comprises a particulate dispersion of photosensitive silver iodobromide, iodochloride or iodochlorobromide grains which possess in terms of the iodide thereof a mean iodide concentration within the range of about 0.5 to 15 mole %, and in which dispersion not in excess of about 20%, by weight, of the silver iodobromide, silver iodochloride or silver iodochlorobromide grains deviate from the mean iodide concentration by in excess of about ± 25%, by weight, iodide, disposed in a photosensitive element which contains a plurality of layers including, in relative order, a dimensionally stable layer preferably opaque to incident actinic radiation; one or more photosensitive silver halide layers having associated therewith diffusion transfer process dye image-forming material; a layer adapted to receive image-forming material diffusing thereto as a function of the point-to-point degree of silver halide layer exposure to incident actinic radiation; a dimensionally stable layer transparent to incident actinic radiation; means for interposing, intermediate the silver halide layers and the reception layer, opacifying agent; and means for providing a processing composition in contact with the photosensitive layers, and, in a particularly preferred embodiment, a processing composition possessing a first pH at which the diffusion transfer process dye image-forming material is diffusible during processing and means for modulating the pH of the film unit from the first pH to a second pH at which the dye image-forming material is substantially nondiffusible subsequent to substantial dye transfer image formation.

In accordance with a specifically preferred embodiment of the present invention, a film unit assemblage of the aforementioned general structural parameters will be adapted to be processed, subsequent to photoexposure, in the presence of actinic radiation and may be fabricated to employ, as means interposed intermediate the reception layer and next adjacent silver halide layer subsequent to photoexposure, an inorganic light-reflecting pigment dispersion containing reflecting pigment and at least one optical filter agent, at a pH above the pKa of the optical filter agent and at which pH the dye image-forming material is diffusible during processing as a function of silver halide layer photoexposure, in a concentration in admixture effective to provide a barrier to transmission of actinic radiation therethrough, and the means for interposing the opacifying agent and the processing composition may comprise a rupturable container, retaining the opacifying agent disposed in the processing composition selected, fixedly positioned extending transverse a leading edge of the film unit and adapted, upon application of compressive pressure, to distribute its contents intermediate the reception layer and next adjacent silver halide layer.

BRIEF DESCRIPTION OF THE DRAWINGS

FIGS. 2, 4 and 6 are diagrammatic enlarged cross-sectional views of the film unit of FIG. 1, along section line 2—2, illustrating the association of elements during the three illustrated stages of the performance of a diffusion transfer process, for the production of a multicolor transfer image according to the invention, the thickness of the various materials being exaggerated, and wherein FIG. 2 represents an exposure stage, FIG. 4 represents a processing stage and FIG. 6 represents a product of the process;

DETAILED DESCRIPTION OF THE INVENTION

Figure 1:
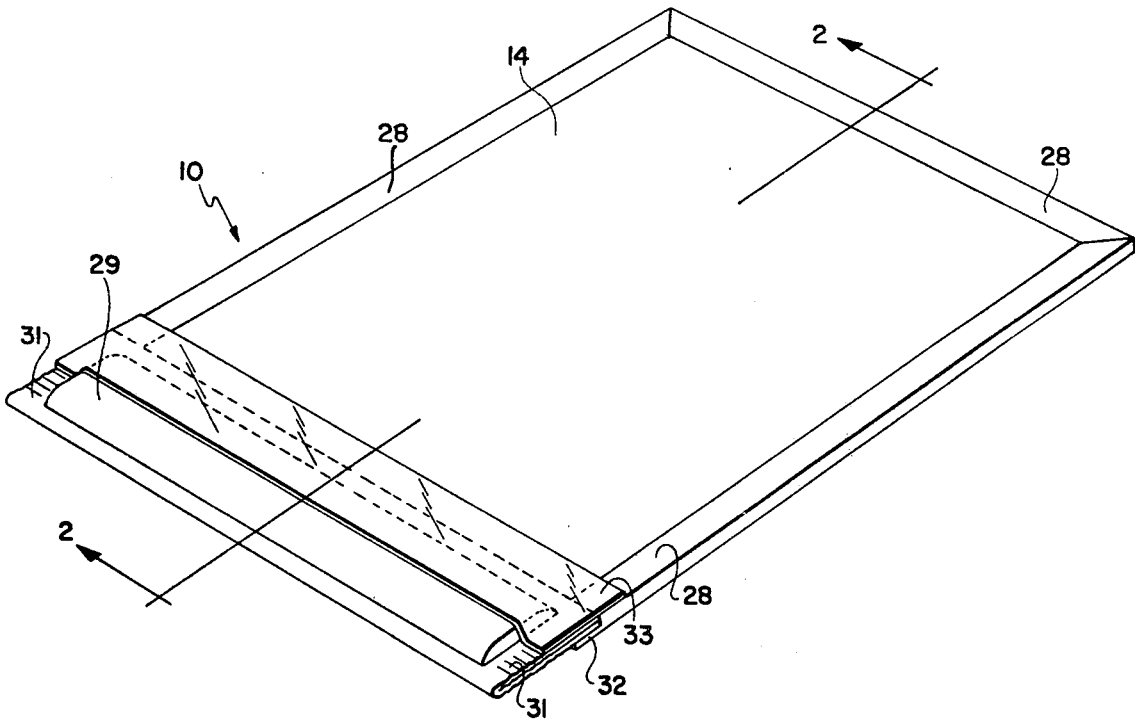
FIG. 1 is a perspective view of a photographic film unit embodying the invention.

As previously characterized, diffusion transfer photographic processing may be employed to provide a positive reflection dye image, as a direct function of actinic radiation incident on a film unit assemblage which unit is preferably constructed to comprise a plurality of sequential layers including a dimensionally stable layer most preferably opaque to incident radiation; a photosensitive silver halide layer having associated therewith dye image-forming material which is processing composition diffusible at a selected first pH as a function of the point-to-point degree of silver halide layer photoexposure; a layer adapted to receive dye image-forming material diffusing thereto; a dimensionally stable layer transparent to incident radiation; means for interposing, intermediate the silver halide layer and the reception layer, opacifying agent, preferably an inorganic reflecting pigment dispersion containing at least one optical filter agent or dye, in a concentration effective to provide, subsequent to selective photoexposure of the silver halide, layer, protection of the silver halide layer from further exposure to actinic radiation incident on the dimensionally stable layer; and means for converting the pH of the film unit from the first processing pH to a second pH at which the dye image-forming material is substantially nondiffusible subsequent to substantial dye image-forming material diffusion to the reception layer.

It now has been discovered, however, that improved photographic reproduction in color by diffusion transfer processing may be accomplished by employment of a diffusion transfer process film unit which comprises a plurality of layers including photosensitive layer comprising polydisperse silver iodobromide, iodochloride or iodochlorobromide grains which contain in terms of the halide proportion thereof a mean iodide concentration within the range of about 1 to 15 mole % and in which layer not in excess of about 20%, by weight, of the silver iodobromide, iodochloride or iodochlorobromide grains deviate from the mean iodide concentration by in excess of about ± 25%, by weight, iodide having associated therewith a diffusion transfer process dye image-providing material and a layer adapted to receive dye image-providing material diffusing thereto, as a function of the point-to-point degree of the photosensitive layer's exposure to incident actinic radiation.

In a preferred embodiment of the present invention, the photosensitive silver iodobromide or iodochlorobromide grains comprising the photosensitive layer possess a mean grain size distribution within the range of about 0.3 to 3.0 $\mu$ and, most preferably, within the range of about 0.5 to 2.0 $\mu$.

Employment of diffusion transfer color process film units possessing the defined photosensitive silver iodobromide and/or iodochlorobromide components has been discovered to provide increased diffusion transfer processing temperature latitude; film unit storage stability; and more efficient and effective utilization of silver, dye image-providing components and photographic adjuvants as, for example, sensitizing dye components of the film unit.

Specifically, the employment of the denoted silver iodobromide, iodochloride or iodochlorobromide component possessing the defined iodide constitution have been unexpectedly found to enhance the dye diffusion control aspects of the dye transfer process with its concomitant improvement in transfer dye image acuity and resolution, and, in multicolor dye transfer processes, improved dye image separation and segregation.

In particular it has been discovered that, with respect to conventional silver iodobromide, silver iodochloride and silver iodochlorobromide emulsions of the art, the concentration of iodide, by weight, present in the crystal lattice of the respective emulsions' grains is a function of the size of such grain relative to the mean iodide concentration of emulsion taken as an entity. Specifically, it has been ascertained that the ratio of iodide to silver present in the crystal lattice decreases as a function of the decrease in grain size. Accordingly, the conventional polydisperse emulsion formulations include a substantial proportion or number of grains possessing an iodide concentration in excess of, or less than, the mean concentration upon which chemical and optical sensitization are based for optimization of the emulsions' photoresponsive characteristics.

The net result of the sensitization procedures employed are the resultant presence of a substantial proportion or number of grains possessing iodide concentration substantially in excess of that adapted to be optionally sensitized with the resultant proclivity of such grains for the formation of undesired fog, which proclivity increases as a direct function of increase in processing temperature, with the concomitant result of less efficient and effective utilization of the selected silver halide concentration per unit weight, degradation of image recordation acuity, for example, increased noise to signal ratio, and corresponding dye transfer image construction.

Conversely, there is also present a substantial proportion or number of grains possessing iodide concentration substantially less than that adapted to be optimally sensitized which grains cannot be effectively sensitized under the selected conditions and accordingly such grains are found to exhibit lower effective sensitivity to photoexposure radiation, thus also resultant in less efficient utilization of silver halide to provide dye transfer image formation as a function of the film unit's exposure to incident actinic radiation. Specifically, the lowermost about 20%, by weight, grains of an approximately 75 Diffusion Transfer Process Exposure Index conventional silver iodobromide emulsion employed in commercial type multicolor dye developer diffusion transfer processes will ordinarily exhibit a loss of speed in excess of one stop, and the uppermost about 20%, by weight, exhibit substantially no H & D curve or discriminatory photoresponse sensitivity due to extensive fog formation upon processing.

Recognizing that although efficient utilization of silver halide in terms of its active species film unit coverage requirement decreases the excess quantities of silver halide, dye image-providing material and photographic adjuvants necessary to factor out inefficient silver halide grain performance, most importantly control of the imagewise generation of and transfer of dye image-providing material is most accurately accomplished employing a silver halide grain distribution the sum total grains of which are active to individually contribute to selective generation and transfer of the image-providing components.

It has been found that the advantages procured by means of the present invention are facilitated by maximizing restriction of the halide distribution to the mean iodide concentration selected to provide the results desired. Irrespective of such optimization, however, the photosensitivity response of the grains may be such as to provide a photoresponse gradient traditionally illustrated by the curve shape of the standard H & D type curve integrating processed silver image density as a function of film unit photoexposure.

It will be recognized that the employment of silver iodochlorobromide, iodochloride and/or iodobromide grain dispersions possessing maximally limited iodide concentration level distribution deviation and the last-mentioned photoresponse characteristics may be readily prepared in a plurality of expeditious manners, including the simple procedure which comprises the blending of dispersions possessing substantially homogeneous or uniform iodide concentration level distributions, within the range denoted above, where the silver halide crystal component of the dispersions forming the ultimate blend possesses the differential electromagnetic radiation sensitivity required for providing the aforementioned photoresponse gradient.

In a particularly preferred embodiment of the present invention, > about 75% and more preferably > about 90% of the photosensitive silver iodochlorobromide, iodochloride and/or iodobromide grains are within the stated range of about 0.3 to 3.0 $\mu$.

The preferred polydisperse silver iodochlorobromide, iodochloride and iodobromide type photosensitive layers employed for the fabrication of the photographic film unit, may be prepared by reacting a water-soluble silver salt, such as silver nitrate, with at least one water-soluble halide, such as ammonium, potassium or sodium chloride, together with corresponding iodide and bromide, or ammonium, potassium or sodium bromide, together with corresponding iodide, in an aqueous solution of a peptizing agent such as colloidal gelatin solution; digesting the dispersion at an elevated temperature, to provide increased crystal growth; washing the resultant dispersion to remove undesirable reaction products and residual water-soluble salts, for example, employing the preferred gelatin matrix material, by chilling the dispersion, noodling the set dispersion, and washing the noodles with cold water, or, alternatively, employing any of the various flocc systems, or procedures, adapted to effect removal of undesired components, for example, the procedures described in U.S. Pat. Nos. 2,614,928; 2,614,929; 2,728,662, and the like; after-ripening the dispersion at an elevated temperature in combination with the addition of gelatin or such other polymeric material as may be desired and various adjuncts, for example, chemical sensitizing agents of U.S. Pat. Nos. 1,574,944; 1,623,499; 2,410,689; 2,597,856; 2,597,915; 2,487,850; 2,518,698; 2,521,926; and the like; all according to the traditional procedures of the art, as described in Neblette, C. B., *Photography Its Materials and Processes*, 6th Ed., 1962.

As previously mentioned, polydisperse photosensitive silver iodochloride, iodobromide and iodochlorobromide emulsions possessing the desired iodide concentration range and the preferred grain size distribution may be readily obtained by the processes and apparatus disclosed in U.S. Pat. Nos. 3,326,641; 3,415,650; and 3,498,454, each of which is specifically hereby incorporated herein by reference. Specifically, an emulsion may be readily classified in accordance with the mass of its individual constituent particles employing any of the various particle classification techniques of the art including those of the last-cited U.S. patents, and in which selected particle size distributions are separated from the formulation in accordance with their photoresponse characteristics as determined by their iodide concentration deviation as a function of mass. The particle size distributions to be selectively separated may be readily ascertained empirically by measurement of their photoresponse characteristics in the separated state against those of the original formulation and the optimized residuum remaining.

Optical sensitization of the emulsion's silver iodobromide and iodochlorobromide crystals may be accomplished by contact of the emulsion composition with an effective concentration of the selected optical sensitizing dyes dissolved in an appropriate dispersing solvent such as methanol, ethanol, acetone, water, and the like; all according to the traditional procedures of the art, as described in Hammer, F. M., *The Cyanine Dyes and Related Compounds*.

Additional optional additives, such as coating aids, hardeners, viscosity-modifying agents, stabilizers, preservatives, and the like, for example, those set forth hereinafter, also may be incorporated in the emulsion formulation, according to the conventional procedures known in the photographic emulsion manufacturing art.

As the binder for the photoresponsive material, the aforementioned gelatin may be, in whole or in part, replaced with some other natural and/or synthetic processing composition permeable polymeric material such as albumin; casein; or zein or resins such as cellulose derivative, as described in U.S. Pat. Nos. 2,322,085 and 2,541,474; vinyl polymers such as described in an extensive multiplicity of readily available U.S. and foreign patents or the photoresponsive material may be present substantially free of interstitial binding agent as described in U.S. Pat. Nos. 2,945,771; 3,145,566; 3,142,567; Newman, *Comment on Non-Gelatin Film*, B. J. O. P., 434, Sept. 15, 1961; and Belgian Pat. Nos. 642,557 and 642,558.

One procedure particularly useful for the production of preferred polydisperse gelatino silver iodohalide emulsions comprises the formulation, for example, in the manner previously detailed, of a silver iodohalide emulsion by initially forming the emulsion, separating from the formulation undesired reaction products, afterripening the resultant silver iodohalide emulsion in combination with the selected auxiliary sensitizing, speed increasing, etc., adjuncts elected and separating from the emulsion formulation about 15 to 30% of the silver halide grains possessing the greatest and/or least mass.

Specifically, a preferred silver iodobromide emulsion may be readily formulated by a conventional single jet addition, over a period of 40 minutes, at a rate of 10 liters per minute from the jet, a solution comprising 3 M. silver nitrate, in distilled water, at room temperature, into a solution comprising 3 M. alkali halide (e.g. potassium) possessing 98% bromide and 2% iodide in trimellitic acid anhydride derivatized acid pig gelatin, at room temperature, preadjusted to pH 6 with 5% sodium hydroxide. The resultant silver iodobromide emulsion is held subsequent to formulation for the period of time required to provide the selected silver halide grain size distribution and separation of the silver iodobromide-trimellitic acid anhydride derivatized gelatin precipitate provided by the addition of 2 N. sulfuric acid to the reaction mixture. The resultant precipitate is washed with chilled distilled water until the wash water exhibits a conductivity of about 300 to 500 $\mu$ mhos/cm, the volume adjusted with distilled water for the addition of 100 gms. of lime bone gelatin per 1000 cc. of emulsion, chemically sensitized at about 56° C., pH 5 and pAg 9, by the addition of a sensitizing amount of a solution containing 0.1 gram of ammonium thiocyanate in 9.9 cc. of water and 1.2 cc. of a solution containing 0.097 gram of gold chloride in 9.9 cc. of water, and a 0.02% aqueous sodium thiosulfate solution optimized for the mean silver halide iodide crystal concentration, and the emulsion then afterripening for three hours at a temperature of 60° C. and a pH of 5.5.

A plurality of the procedures which exist in the art, including those of the last-cited U.S. patents and applications, employ mechanical particle classifier apparatus and techniques adapted to differentially separate materials of varying densities and materials of the same density and varying mass, which are, accordingly, particularly adapted to classify polydisperse silver iodochlorobromide, iodochloride and/or iodobromide grains into desired distribution ranges and, at the election of the operator, provide further concentration or dilution of emulsion fluid volume specifically including countercurrent centrifugal exchange devices; conventional mechanical centrifugation devices and procedures; in process centrifugal force field extraction employing hydrocyclone devices and procedures, etc.; positive sedimentation devices and procedures; and the like.

Figure 8:
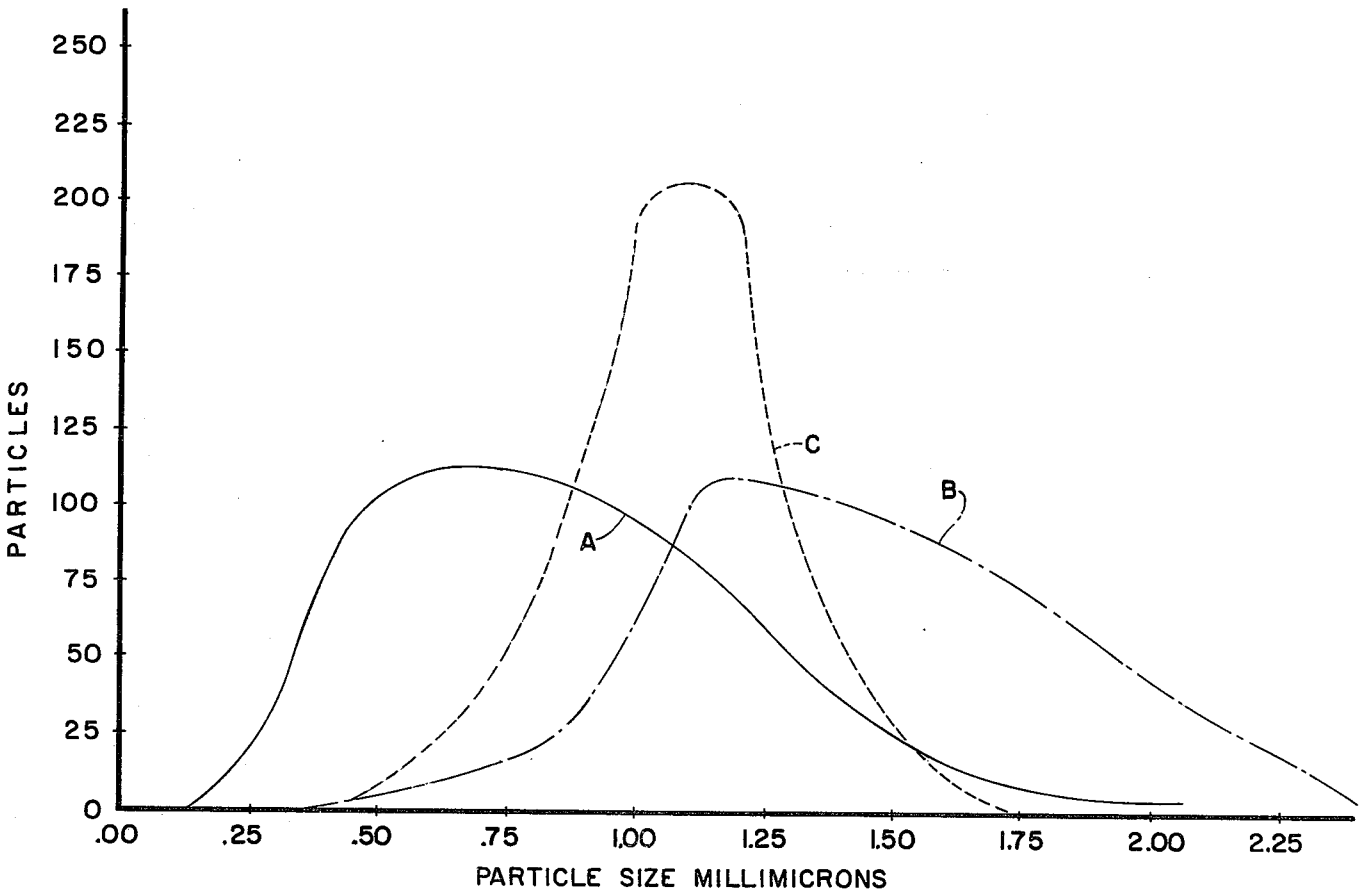
FIG. 8 is a graphic representation of the particle size distribution curves of specified silver halide emulsion formulations detailed hereinafter.

Referring to FIG. 8, there is set forth a graph showing the particle size distribution, determined by plotting the silver iodobromide particle count per unit test area measured as a function of particle size employing a Zeiss TGZ-3 particle size analyzer, of a silver iodobromide emulsion prepared as set forth above wherein Curve A represents the particle size distribution prior to classification, Curve B represents the particle size distribution of the large diameter fraction separated from the emulsion formulation providing Curve A, and Curve C represents the particle size distribution of the emulsion subsequent to separation of the denoted large diameter fraction of Curve B and the small diameter fraction of the emulsion formulation providing Curve A, in each instance the respective mechanical classification being accomplished in accordance with the general technique and apparatus disclosed in aforementioned U.S. Pat. No. 3,498,454 and specifically in accordance with the illustrative example set forth therein.

In preferred embodiments of the present invention, the polydisperse photosensitive silver iodochlorobromide, iodochloride and/or iodobromide emulsions employed will be emulsions adapted to provide a Diffusion Transfer Process Exposure Index $<$ about 50, which Index indicates the correct exposure rating of a diffusion transfer color process at which an exposure meter, calibrated to the ASA Exposure Index, must be set in order that it give correct exposure data for producing color transfer prints of satisfactorily high quality. The Diffusion Transfer Process Exposure Index is based on a characteristic H & D curve relating original exposure of the photosensitive silver iodochlorobromide, iodochloride and/or iodobromide emulsion to the respective curve densities forming the resultant transfer image. Thus, the Diffusion Transfer Exposure Index is based on the exposure to which the polydisperse silver iodochlorobromide, iodochloride and/or iodobromide emulsion, for use in color diffusion transfer processes, must be subjected in order to obtain an acceptable color transfer image by that process and is a direct guide to the exposure setting to be entered in a camera in order to obtain proper exposure of the film unit.

In accordance with the present invention, it has also been discovered that excellent diffusion transfer dye image characteristic curve shape control, i.e., control of the transfer image characteristics represented graphically by the curve integrating dye density of the transfer image as a function of the log exposure of the photosensitive silver halide layer, may be obtained by utilization of a photosensitive silver halide layer which comprises a blend of differentially photosensitive silver halide dispersions at least one of the dispersions comprising the silver iodochlorobromide, iodochloride and/or iodobromide dispersions described above in admixture, for example, with a second, etc., silver chlorobromide, -bromide, or, preferably, -iodobromide, -iodochloride or -iodochlorobromide dispersion or dispersions formulated as detailed herein, which blend preferably may possess a mean particle size within the previously denoted range of about 0.3 to 3.0 $\mu$.

Specifically, upon blending the aforementioned differentially sensitive silver halide dispersions, the characteristic curve of the dye transfer image resultant from employment of the blend assumes the "shoulder", i.e., low photosensitive silver halide layer photoexposure region, "speed", i.e., relative measurement defined as a value representing the reciprocal of the exposure required to produce a predetermined result, of the fastest silver halide dispersion and the "toe", i.e., high photosensitive layer photoexposure region, "speed" of the slowest silver halide dispersion, thus increasing the exposure latitude range and lowering the resultant slope or gamma of the curve.

There is thus provided the capacity for controlled formulation of photosensitive layers exhibiting a selectively extended range of predetermined gammas or contrasts and "exposure latitudes" or "dynamic ranges", i.e., the relative measurement of the range of exposure from which a useful dye transfer image may be derived; the instant invention thereby providing the capability of a high maximum density, low minimum density and extended dynamic range dye diffusion transfer imaging system and thus adapted to more advantageously reproduce, as dye transfer image differences, the luminance differences existing in an object to be photographically reproduced, including optimization of the minimum useful exposures required to reproduce minimum differences existing in the shadow regions of the object to be reproduced by means of some minimum density differences in resultant dye transfer image conformation.

Figure 9:
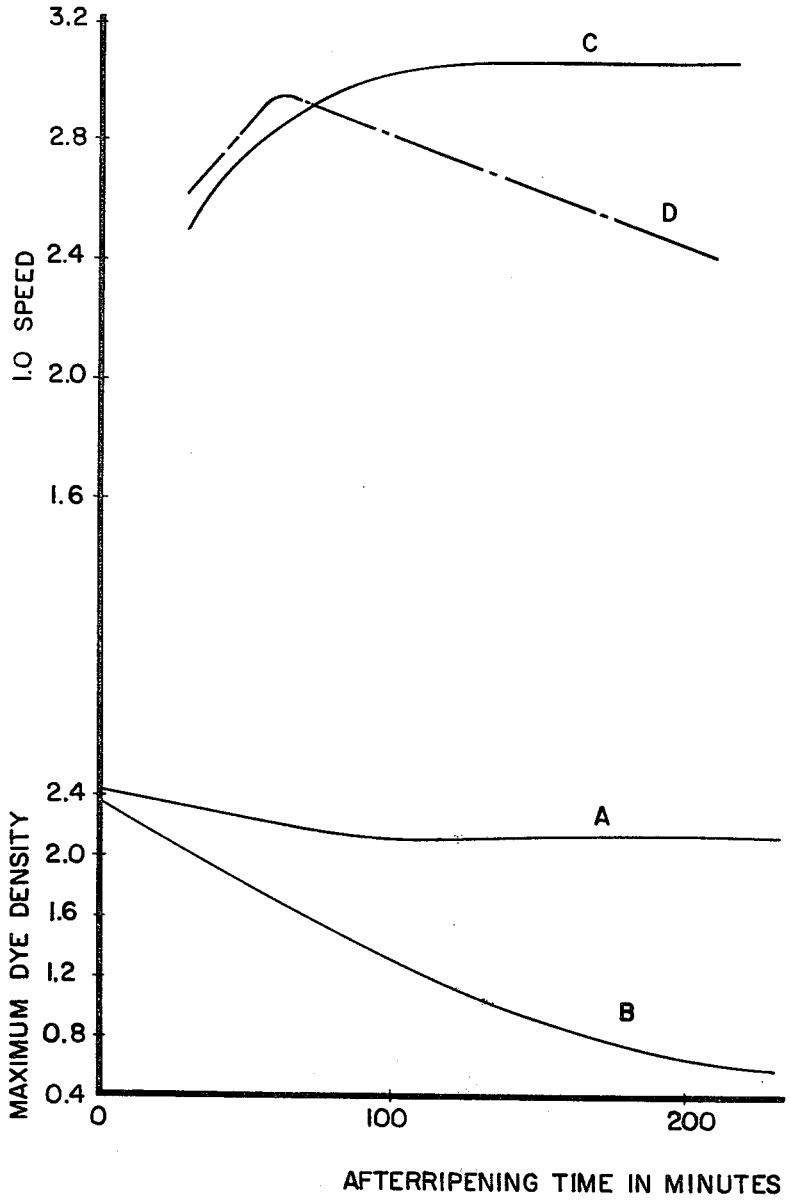
FIG. 9 is a graphic representation of (1) the characteristic curves of specified monochromatic dye transfer images and (2) photographic 1.0 film unit speeds of illustrative dye diffusion transfer process film units employing certain silver halide emulsion formulation particle size distributions detailed with respect to FIG. 8.

The results denoted in FIG. 9 illustrate graphically that desired dye transfer characteristic curve performance may be readily obtained by silver halide dispersions of the present invention to provide selected composite sensitometric results.

For the production of the data denoted as FIG. 9, film units were prepared by coating a polyester film base, in order, with a layer of the magenta dye developer

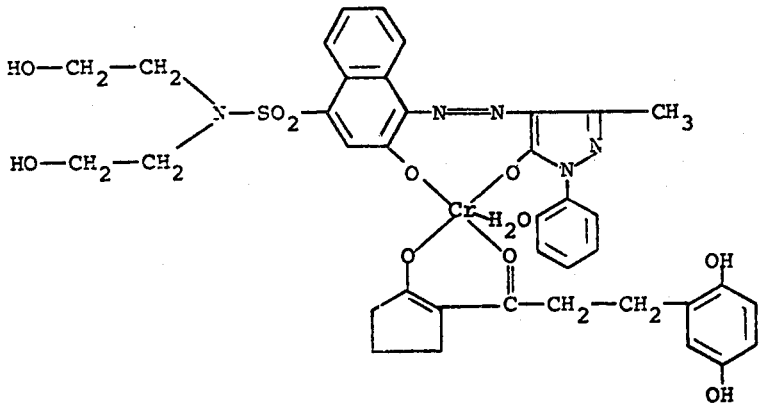

dispersed in gelatin and coated at a coverage of about 70 mgs./ft.$^2$ dye and about 70 mgs./ft.$^2$ gelatin, the gelatino silver iodobromide emulsions of FIG. 8 Curves A and B, respectively, coated at a coverage of about 100 mgs./ft.$^2$ silver and about 100 mgs./ft.$^2$ gelatin and prepared in the manner denoted above.

A rupturable container, constructed as detailed hereinafter, containing an aqueous alkaline processing composition comprising:

| | | | |
|---|---|---|---|
| Water | ~ | 59.42 | gms. |
| Potassium hydroxide | | 4.40 | gms. |
| Cesium hydroxide | ~ | 2.78 | gms. |
| Sodium carboxymethyl cellulose (Commercially available from Hercules Powder Co., Wilmington, Delaware, under the trade designation Hercules Type 7H4F providing a viscosity of 3000 cps. at 1% in water at 25° C.) | ~ | 2.01 | gms. |
| N-Phenethyl-α-picolinium bromide | ~ | 0.86 | gms. |
| Titanium dioxide | ~ | 29.06 | gms. |
| 4-Methylphenyl hydroquinone | ~ | 0.20 | gms. |
| 2-Methylimidazole | ~ | 0.21 | gms. |
| Benzotriazole | ~ | 0.59 | gms. |
| 5-Hydroxyazabenzimidazole | ~ | 0.06 | gms. |
| 5-Bromo-6-methylazabenzimidazole | ~ | 0.03 | gms. |

was then mounted on the leading edge of each film unit such that, subsequent to exposure of each unit and upon application of compressive force to a container, its contents are distributed, upon rupture of the container, between the unit and the image-receptive layer of a contiguous dye transfer image-receiving element superposed coextensive the surface of the emulsion layer; the dye transfer image-receiving element prepared by coating a transparent 5 mil. polyester film base, in succession, with the following illustrative layers:

1. the partial butyl ester of polyethylene/maleic anhydride copolymer to provide a polymeric acid layer at a coverage of about 2500 mgs./ft.$^2$;

2. a timing layer containing about a 40:1 ratio of a 60-30-4-6 copolymer of butylacrylate, diacetone acrylamide, styrene and methacrylic acid, and polyacrylamide at a coverage of about 500 mgs./ft.$^2$; and 3. a 2:1 mixture, by weight, of polyvinyl alcohol and poly-4-vinylpyridine, at a coverage of about 400 mgs./ft.$^2$ to provide a polymeric image-receiving layer.

Specifically, control film units employing the emulsions of FIG. 8 Curve A and test film units employing emulsions of FIG. 8 Curve B were each exposed to a conventional step wedge to provide the graphic illustration of the characteristic curves of the respective dye transfer images and set forth in FIG. 9, the 1.0 photographic speed curves of the dye transfer process, wherein the detailed control and test Curves A and B, respectively, represent a plot of the magenta dye transfer maximum density as a function of the afterripening time of the respective emulsion formulations; and the detailed control and test Curves C and D, respectively, represent a plot of the photoresponse speed of the film unit at a density of 1.0, as measured on an H & D sensitometric characteristic curve plotting dye transfer density as a function of the exposure of the film unit to incident radiation actinic to the emulsion formulation employed, as a function of afterripening time of the selected emulsion formulation.

As will be expressly noted from direct examination of the respective curves, the previously described fogging propensity of the separated emulsion fraction is clearly estabished and significant improvement in dye transfer image control as a direct function of photoexposure may be readily achieved by separation of the undesired fraction from the emulsion formulation selected to constitute the photographic film unit. In addition, it is noted that such separation obviates deleteriously speed effects resultant from maintenance of the separated fraction within the formulation to be employed in the fabrication of the dye diffusion transfer process film unit.

In a preferred embodiment of the present invention, the means for interposing the processing composition selected intermediate the reception layer and the silver iodochlorobromide layer comprises a rupturable container retaining a processing composition comprising the solvent and pH concentrations required fixedly positioned and extending transverse a leading edge of the film unit to effect, upon application of compressive pressure, discharge of the processing composition intermediate the reception layer and the photosensitive silver iodochlorobromide layer next adjacent. In such embodiment the opacifying agent is preferably disposed within the processing composition, as retained in the rupturable container, for distribution as a component of such composition intermediate the reception and silver halide layers, subsequent to selective exposure of the film unit.

Multicolor images may be obtained using color imageforming components in the diffusion transfer process of the present invention by several techniques. One such technique contemplates obtaining multicolor transfer images utilizing, for example, dye developers as dye image-providing materials by employment of an integral multilayer photosensitive element, such as is disclosed in aforementioned U.S. Pat. No. 3,415,644 wherein at least two selectively sensitized photosensitive strata, superposed on a single support, are processed, simultaneously and without separation, with a single common imagereceiving layer. A suitable arrangement of this type comprises the opaque support carrying a red-sensitive silver iodochlorobromide, iodochloride and/or iodobromide stratum, a green-sensitive silver iodochlorobromide, iodochloride and/or iodobromide stratum and a blue-sensitive silver iodochlorobromide, iodochloride and/or iodobromide stratum, said emulsions having associated therewith, respectively, for example, a cyan dye developer, a magenta dye developer and a yellow dye developer. The dye developer may be utilized in the silver iodochlorobromide, iodochloride and/or iodobromide stratum, for example, in the form of particles, or it may be employed as a layer behind the appropriate silver iodochlorobromide, iodochloride and/or iodobromide strata. Each set of silver iodochlorobromide, iodochloride and/or iodobromide strata and associated dye developer strata are disclosed to be optionally separated from other sets by suitable interlayers, for example, by a layer of gelatin or polyvinyl alcohol. In certain instances, it may be desirable to incorporate a yellow filter in front of the green-sensitive emulsion and such yellow filter may be incorporated in an interlayer. However, where desirable, a yellow dye developer of the appropriate spectral characteristics and present in a state capable of functioning as a yellow filter may be employed. In such instances, a separate yellow filter may be omitted.

In a preferred embodiment of the present invention, the film unit is specifically adapted to provide for the production of a multicolor dye transfer image and the photo-sensitive laminate comprises, in order of essential layers, the dimensionally stable opaque layer; at least two selectively sensitized silver iodochlorobromide, iodochloride and/or iodobromide strata each having dye image-providing material of predetermined color associated therewith, for example, dye developers as detailed above, which are soluble and diffusible in processing composition as a function of the point-to-point degree of exposure of the respective associated silver iodochlorobromide, iodochloride and/or iodobromide stratum; a polymeric layer dyeable by the dye image-providing materials; and a dimensionally stable transparent layer.

In view of the fact that the preferred dye image-providing materials comprise dyes which are silver halide developing agents, as stated above, for purposes of simplicity and clarity, the present invention will be further described hereinafter in terms of such dyes, without limitation of the invention to the illustrative dyes denoted, and, in addition the photographic film unit structure will be detailed hereinafter employing the last-mentioned preferred structural embodiment, without limitation of the invention to the preferred structure denoted.

The dye developers, as noted above, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group. Other suitable developing functions include ortho-dihydroxyphenyl and ortho- and para-amino substituted hydroxyphenyl groups. In general, the development function includes a benzenoid developing function, that is, an aromatic developing group which forms quinonoid or quinone substances when oxidized.

The dye developers are preferably selected for their ability to provide colors that are useful in carrying out subtractive color photography, that is, the previously mentioned cyan, magenta and yellow. The dye developers employed may be incorporated in the respective silver halide emulsion or, in the preferred embodiment, in a separate layer behind the respective silver halide stratum. Specifically, the dye developer may, for example, be in a coating or layer behind the respective silver halide stratum and such a layer of dye developer may be applied by use of a coating solution containing about 0.5 to 8%, by weight, of the respective dye developer distributed in a film-forming natural, or synthetic, polymer, for example, gelatin, polyvinyl alcohol, and the like, adapted to be permeated by the chosen diffusion transfer fluid processing composition.

The polydisperse silver iodochlorobromide, iodochloride and/or iodobromide strata comprising the multicolor photosensitive laminate preferably possess predominant spectral sensitivity to separate regions of the spectrum and each has associated therewith a dye which is a silver halide developing agent and is, most preferably, substantially soluble in the reduced form only at a first pH possessing, subsequent to processing, a spectral absorption range substantially complementary to the predominant sensitivity range of its associated emulsion.

In the preferred embodiment, each of the silver halide strata, and its associated dye, is separated from the remaining strata, and their associated dye, by separate alkaline solution permeable polymeric interlayers.

In such preferred embodiment of the invention, the silver halide strata comprises photosensitive silver iodochlorobromide and/or iodobromide dispersed in gelatin and are about 0.6 to 6 $\mu$ in thickness; the dye itself is dispersed in an aqueous alkaline solution polymeric binder, preferably gelatin, as a separate layer about 1 to 7 $\mu$ in thickness; the alkaline solution permeable polymeric interlayers, preferably gelatin, are about 1 to 5 $\mu$ in thickness; the dyeable polymeric layer is transparent and about 0.25 to 0.4 mil. in thickness; and each of the dimensionally stable opaque and transparent layers are alkaline solution impermeable, processing composition vapor permeable and about 2 to 6 mils. in thickness. It will be specifically recognized that the relative dimensions recited above may be appropriately modified, in accordance with the desires of the operator, with respect to the specific product to be ultimately prepared.

Although in one embodiment of the present invention, the dimensionally stable layers employed in the practice of the invention may possess a vapor transmission rate of 1 or less gms./24 hrs./100 in.$^2$/mil., in a preferred embodiment of the invention, the layers employed will possess a vapor transmission rate for the selected processing composition solvent averaging not less than about 100 gms./24 hrs./100 in.$^2$/mil., most preferably in terms of the preferred solvent, water, a vapor transmission rate averaging in excess of about 300 gms. of water/24 hrs./100 in.$^2$/mil., and may advantageously comprise a microporous polymeric film possessing a pore distribution which does not unduly interfere with the dimensional stability of the layers or, where required, the optical characteristics of such layers. Such pore distribution may comprise, for example, an average pore diameter of from < about 20 $\mu$ to > about 100 $\mu$ and a pore volume of < about 3% to > about 7%.

In a particularly preferred embodiment of the present invention, the preferred solvent, water, may be employed in a weight/weight ratio of about 1:10 to 1:20 dye to water at a ratio of about 1:3 to 1:10 liquid permeable polymer to water and most preferably will be fabricated to comprise about 300 to 1300 mgs./ft.$^2$ liquid permeable polymeric binder material, about 200 to 400 mgs./ft.$^2$ dye and about 5000 mgs./ft.$^2$ water.

The preferred dimensionally stable layers are designed so that there is no liquid flow through the layers while allowing the vapor of the processing composition solvent to pass by diffusion from the evaporating liquid body and the operational efficiency of the film unit is directly dependent upon the nature and quality of the vapor permeable membrance characteristics of the layers selected. The vapor transmission characteristics desired are directed to maximization of the rate at which the required quantity of processing solvent is effectively evacuated from the film unit subsequent to substantial dye transfer image formation by diffusion transfer processing, commensurate with maintaning the liquid impermeability and dimensional stability characteristics of the layers. Thus, the layers should possess the maximum vapor transmission capacity which permits the passage of processing composition solvent vapor, and any gas dissolved therein, at its vapor pressure, without allowing passage of fluid processing composition. The layers employed in accordance with the present invention therefor should be as thin as possible for solvent vapor transmission efficiency yet retain sufficient strength to provide stability to and resist chemical and physical degradation of the film unit under conditions of use.

In the preferred embodiment of the present invention's film unit for the production of a multicolor transfer image, the respective silver halide/dye developer units of the photosensitive element will be in the form of a tripack configuration which will ordinarily comprise a cyan dye developer/red-sensitive emulsion unit contiguous the dimensionally stable opaque layer, the yellow dye developer/blue-sensitive emulsion unit most distant from the opaque layer and the magenta dye developer/green-sensitive emulsion unit intermediate those units, recognizing that the relative order of such units may be varied in accordance with the desires of the operator.

Reference is now made to FIGS. 1 through 7 of the drawings wherein there is illustrated a preferred film unit of the present invention and wherein like numbers, appearing in the various figures, refer to like components.

As illustrated in the drawings, FIG. 1 sets forth a perspective view of the film unit, designated 10, and each of FIGS. 2 through 7 illustrate diagrammatic cross-sectional views of film unit 10, along the stated section lines 2—2, 3—3, 5—5 and 7—7, during the various depicted stages in the performance of a photographic diffusion transfer process as detailed hereinafter.

Film unit 10 comprises rupturable container 11, retaining, prior to processing, aqueous processing composition 12, and photosensitive laminate 13 including, in order, dimensionally stable opaque layer 14, preferably an actinic radiation-opaque flexible sheet material; cyan dye developer layer 15; red-sensitive silver iodochlorobromide, iodochloride and/or iodobromide emulsion layer 16 possessing the parameters denoted above; interlayer 17; magenta dye developer layer 18; green-sensitive silver iodochlorobromide, iodochloride and/or iodobromide emulsion layer 19 possessing the parameters denoted above; interlayer 20; yellow dye developer layer 21; blue-sensitive silver iodochlorobromide, iodochloride and/or iodobromide emulsion layer 22 possessing the parameters denoted above; auxiliary layer 23, which may contain an auxiliary silver halide developing agent; image-receiving layer 24; spacer layer 25; neutralizing layer 26; and dimensionally stable transparent layer 27, preferably an actinic radiation transmissive flexible sheet material.

The structural integrity of laminate 13 may be maintained, at least in part, by the adhesive capacity exhibited between the various layers comprising the laminate at their opposed surfaces. However, the adhesive capacity exhibited at an interface intermediate image-receiving layer 24 and the silver iodochlorobromide, iodochloride and/or iodobromide emulsion layer next adjacent thereto, for example, image-receiving layer 24 and auxiliary layer 23 as illustrated in FIGS. 2 through 7, should be less than that exhibited at the interface between the opposed surfaces of the remainder of the layers forming the laminate, in order to facilitate distribution of processing solution 12 intermediate the stated image-receiving layer 24 and the silver iodochlorobromide, iodochloride and/or iodobromide emulsion layer next adjacent thereto. The laminate's structural integrity may also be enhanced or provided, in whole or in part, by providing a binding member extending around, for example, the edges of laminate 13, and maintaining the layers comprising the laminate intact, except at the interface between layers 23 and 24 during distribution of processing composition 12 intermediate those layers. As illustrated in the figures, the binding member may comprise a pressure-sensitive tape 28 securing and/or maintaining the layers of laminate 13 together at its respective edges. Tape 28 will also act to maintain processing solution 12 intermediate image-receiving layer 24 and the silver iodochlorobromide, indochloride and/or iodobromide emulsion layer next adjacent thereto, upon application of compressive pressure to pod 11 and distribution of its contents intermediate the stated layers. Under such circumstances, binder tape 28 will act to prevent leakage of fluid processing composition from the film unit's laminate during and subsequent to photographic processing.

Rupturable container 11 may be of the type shown and described in any of U.S. Pat. Nos. 2,543,181; 2,634,886; 3,653,732; 2,723,051; 3,056,492; 3,056,491; 3,152,515; and the like. In general, such containers will comprise a rectangular blank of fluid- and air-impervious sheet material folded longitudinally upon itself to form two walls 29 which are sealed to one another along their longitudinal and end margins to form a cavity in which processing composition 12 is retained. The longitudinal marginal seal 30 is made weaker than he end seals 31 so as to become unsealed in response to the hydraulic pressure generated within the fluid contents 12 of the container by the application of compressive pressure to walls 29 of the container.

Figure 2:
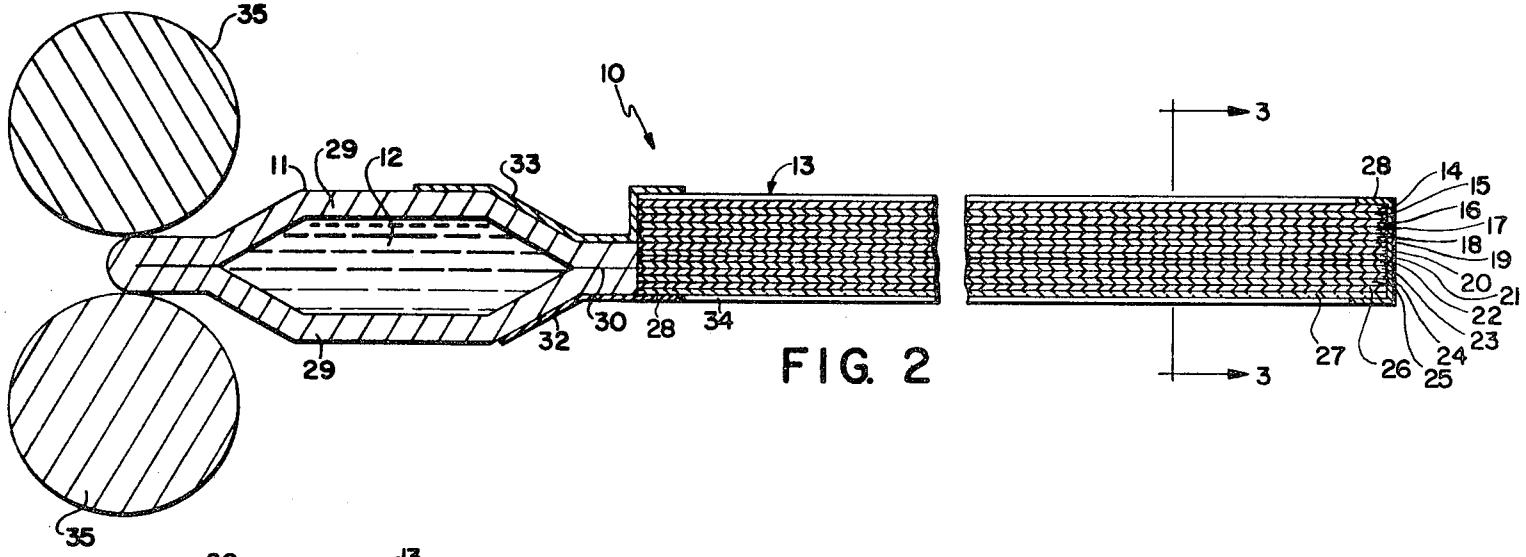
Figure 3:
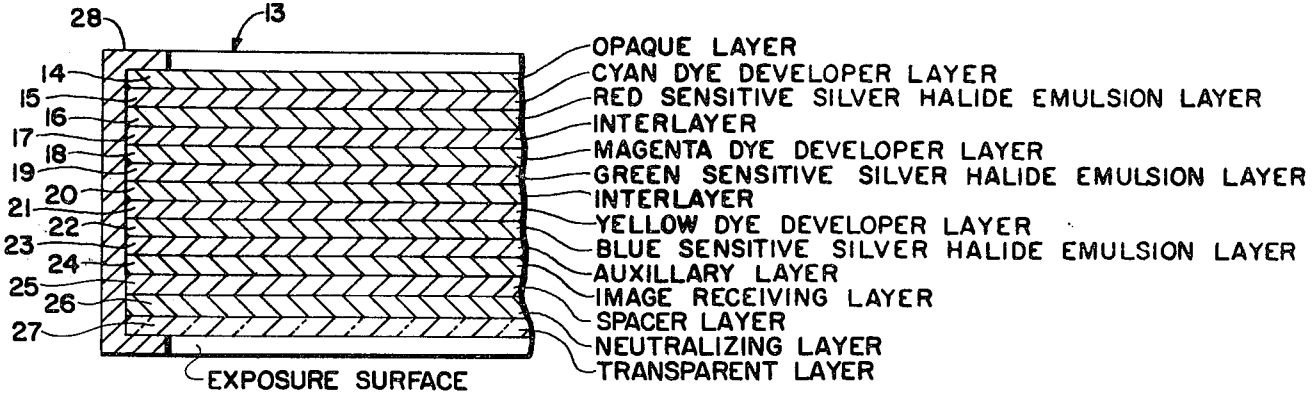
FIGS. 3, 5 and 7 are diagrammatic, further enlarged cross-sectional views of the film unit of FIGS. 2, 4 and 6, along section lines 3—3, 5—5 and 7—7, respectively, further illustrating, in detail, the arrangement of layers comprising the photosensitive laminate during the three illustrated stages of the transfer process.
Figure 4:
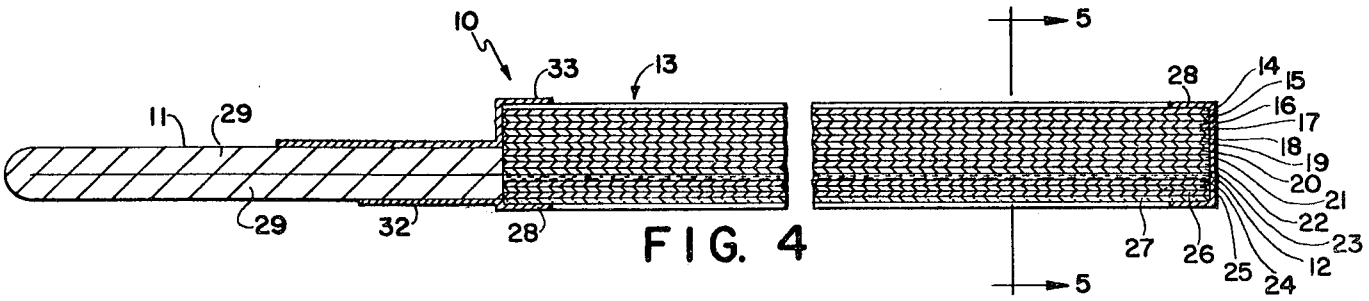
Figure 5:
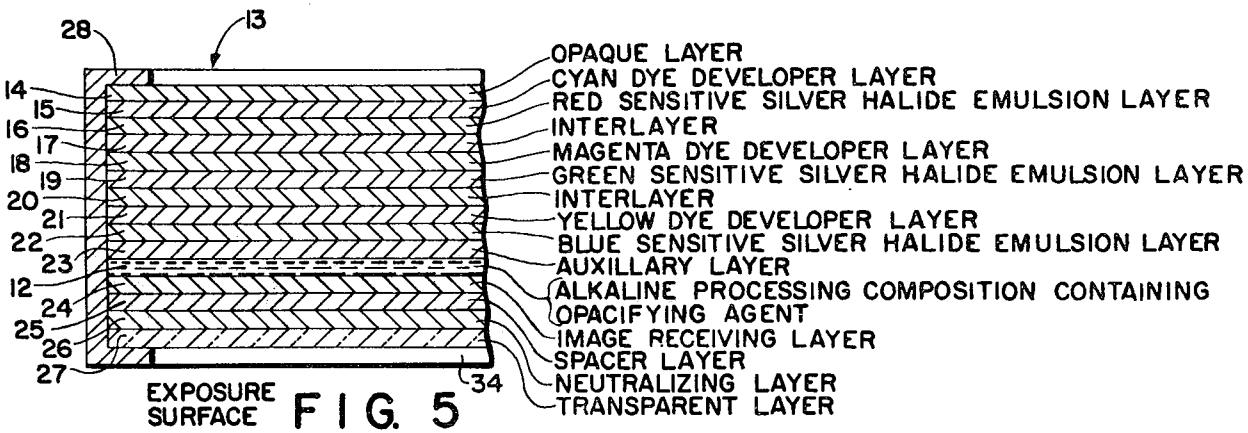
Figure 6:
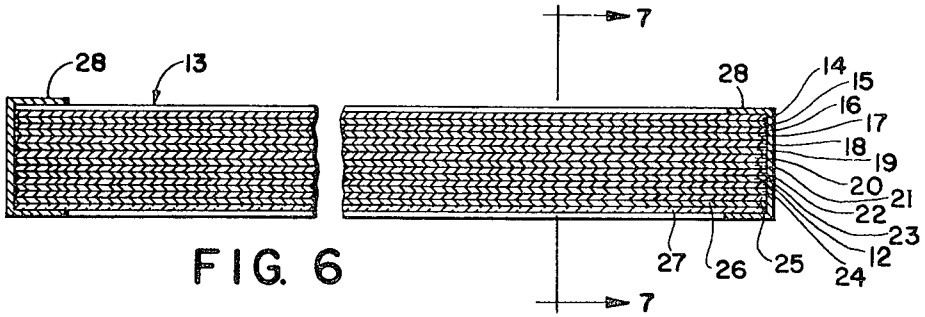
Figure 7:
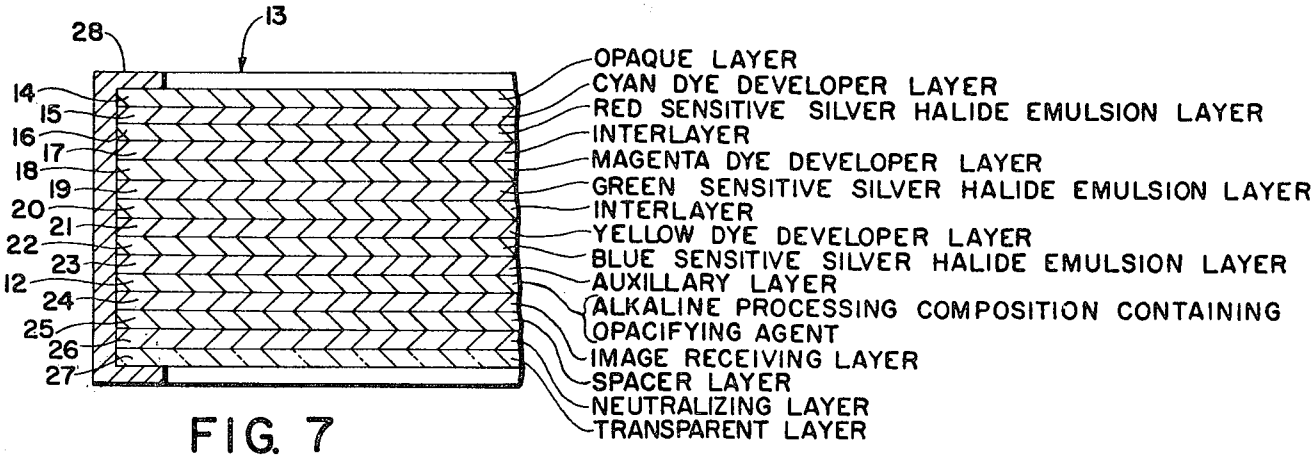

As illustrated in FIGS. 1, 2 and 3, container 11 is fixedly positioned and extends transverse a leading edge of photosensitive laminate 13 whereby to effect unidirectional discharge of the container's contents 12 between image-receiving layer 24 and the stated layer next adjacent thereto, upon application of compressive force to container 11. Thus, container 11, as illustrated in FIG. 2, is fixedly positioned and extends transverse a leading edge of laminate 13 with its longitudinal marginal seal 30 directed toward the interface between image-receiving layer 24 and auxiliary layer 23. As shown in FIGS. 1, 2 and 4, container 11 is fixedly secured to laminate 13 by extension 32 of tape 28 extending over a portion of one wall 29 of the container, in combination with a separate retaining member such as illustrated retaining tape 33 extending over a portion of laminate 13's surface generally equal in area to about that covered by tape 28.

As illustrated in FIGS. 1, 2 and 4, extension flap 32 of tape 28 is preferably of such area and dimensions that upon, for example, manual separation of container 11 and tape 33, subsequent to distribution of processing composition 12, from the remainder of film unit 10, flap 32 may be folded over the edge of laminate 13, previously covered by tape 33, in order to facilitate maintenance of the laminate's structural integrity, for example, during the flexations inevitable in storage and use of the processed film unit, and to provide a suitable mask or frame, for viewing of the transfer image through the picture viewing area of transparent layer 27.

The fluid contents of the container preferably comprise an aqueous alkaline solution having a pH and solvent concentration at which the dye developers are soluble and diffusible and contains inorganic light-reflecting pigment and at least one optical filter agent at a pH above the pKa of such agent in a quantity sufficient, upon distribution, effective to provide a layer exhibiting optical transmission density > about 6.0 and optical reflection density < about 1.0 to prevent exposure of photosensitive silver iodochlorobromide, iodochloride and/or iodobromide emulsion layers 16, 19 and 22 by actinic radiation incident on dimensionally stable transparent layer 27 during processing in the presence of such radiation and to afford immediate viewing of dye image formation in image-receiving layer 24 during and subsequent to dye transfer image formation. Accordingly, the film unit may be processed, subsequent to distribution of the composition, in the presence of such radiation, in view of the fact that the silver iodochlorobromide, iodochloride and/or iodobromide emulsion or emulsions of laminate are appropriately protected by incident radiation, at one major surface of the opaque processing composition and at the remaining major surface by the dimensionally stable opaque layer. If the illustrated binder tapes are also opaque, edge leakage of actinic radiation incident on the emulsion or emulsions will also be prevented.

The selected reflecting pigment should be one providing a background suitable for viewing the dye developer transfer image formed in the dyeable polymeric layer. In general, while substantially any reflecting agent may be employed, it is preferred that a reflecting agent be selected that will not interfere with the color integrity of the dye transfer image, as viewed by the observer, and, most preferably, an agent which is aesthetically pleasing to the viewer and does not provide a background noise signal degrading, or detracting from, the information content of the image. Particularly desirable reflecting agents will be those providing a white background, for viewing the transfer image, and specifically those conventionally employed to provide background for reflection photographic prints and, especially those agents possessing the optical properties desired for reflection of incident radiation.

As examples of reflecting pigments adapted for employment in the practice of the present invention, mention may be made of barium sulfate, zinc sulfide, titanium dioxide, barium stearate, silver flake, silicates, alumina, zirconium oxide, zirconium acetyl acetate, sodium zirconium sulfate, kaolin, mica, and the like.

A particularly preferred reflecting agent comprises titanium dioxide due to its highly effective reflection properties. In general, in such preferred embodiment, based upon percent titanium dioxide (weight/volume) a processing composition containing about 1500 to 4000 mgs./ft.$^2$ titanium dioxide dispersed in 100 cc. of water will provide a percent reflectance of about 85 to 90%. In the most preferred embodiments, the percent reflectance particularly desired will be in the order of > about 85%.

In embodiments wherein the dispersion comprises a preformed layer positioned intermediate the reception layer and next adjacent silver iodochlorobromide, iodochloride and/or iodobromide layer, the pigment layer will be sufficiently transparent to allow transit of exposing radiation through the pigment layer and may comprise titanium dioxide reflecting agent possessing a particle size distribution averaging < about 0.2 $\mu$ in diameter and preferably < about 0.05 $\mu$ in diameter as initially present preceding exposure of the film unit, which preferred materials, upon contact with aqueous alkaline processing composition, preferably aggregate to provide particles possessing a diameter > about 0.2 $\mu$ in diameter and will be coated at a coverage of about 200 to 1000 mgs./ft.$^2$. Specifically, the reflecting agent will be present in a quantity insufficient to prevent exposure of the emulsion layers by actinic radiation incident on the dimensionally stable transparent layer of the film unit but in concentration sufficient, subsequent to processing, to mask dye developer associated with the silver iodochlorobromide, iodochloride and/or iodobromide emulsion strata from the dye transfer image. In the preferred construction of such embodiment, the pigment such as titanium dioxide will be initially present in a relatively small particle size to provide unexpectedly efficient transit of radiation through the reflecting layer during exposure which upon contact with an alkaline processing composition and aggregation of the pigment particles provides efficient light reflectivity and masking capacity subsequent to such aggregation.

In general, the reflecting agents to be employed are those which remain substantially immobile within their respective compositions during and subsequent to photographic processing and particularly those which comprise insoluble and nondiffusible inorganic pigment dispersions within the layer in which they are disposed.

Where desired, reflecting agent pigment may thus be distributed in whole or in part within a processing composition permeable polymeric matrix such as gelatin and/or any other such polymeric matrixes as are specifically denoted throughout the specification as suitable for employment as a matrix binder and may be distributed in one or more of the film unit layers wich may be separated or contiguous, intermediate the image-receiving layer and next adjacent silver iodochlorobromide, iodochloride and/or iodobromide layer, provided that its distribution and concentration is effective to provide the denoted post processing masking function, and/or in whole or in part the reflecting agent may be ultimately disposed within the processing composition residuum located intermediate the image-receiving layer and next adjacent silver iodochlorobromide, iodochloride and/or iodobromide emulsion strata and associated dye image-forming material.

The optical filter agent selected should be one exhibiting, at a pH above its pKa, maximum spectral absorption of radiation at the wavelengths to which the flm unit's photosensitive silver iodochlorobromide, iodochloride and/or iodobromide layer or layers are sensitive and should be substantially immobile or nondiffusible within the pigment dispersion, during performance of its radiation filtration function, in order to maintain and enhance the optical integrity of the dispersion as a radiation filter unit functioning in accordance with the present invention, and to prevent its diffusion into and localized concentration within the image-receiving layer thereby decreasing the efficiency of the reflecting pigment dispersion as a background against which image formation may be immediately viewed, during the initial stages in the diffusion transfer processing of the film unit, by filter agent absorption of dispersion reflected visible radiation prior to reduction in the environmental pH below the pKa of the agent. Commensurate with the spectral sensitivity range of the associated silver halide layer or layers, the optical filter agent selected may comprise one or more filter dyes possessing absorption complementary to such silver iodochlorobromide layers in order to provide effective protection against physical fog providing radiation during processing. Recognizing that the filter agent absorption will derogate from image-viewing characteristics by contaminating reflecting pigment background, the selected agents should be those exhibiting major spectral absorption at the pH at which processing is effected and minimal absorption at a pH below that which obtains during transfer image formation. Accordingly, the selected optical filter agent or agents should possess a pKa below that of the processing pH and above that of the environmental pH subsequent to transfer image formation, and will be preferably selected for employment in the minimum concentration necessary to provide an optical transmission density > about 6.0, at wavelengths at which the silver iodochlorobromide layer is maximally responsive, and an optical reflection density < about 1.0 at such wavelengths.

As specific examples of such pH-sensitive optical filter agents adapted for employment in the practice of the present invention, reference is directed to the agents set forth in aforementioned U.S. Pat. No. 3,647,437, incorporated herein by reference.

In general, preferred agents, both opacifying and filter, are those which remain immobile within their respective compositions during and subsequent to photograhic processing and particularly those which comprise insoluble and nondiffusible materials.

As disclosed in the previously cited patents, the liquid processing composition referred to for effecting multicolor diffusion transfer processes comprises at least an aqueous solution of an alkaline material, for example, diethylamine, sodium hydroxide or sodium carbonate and the like, and preferably possessing a pH in excess of 12, and most preferably includes a viscosity-increasing compound constituting a film-forming material of the type which, when the composition is spread and dried, forms a relatively firm and relatively stable film. The preferred film-forming materials disclosed comprise high molecular weight polymers such as polymeric, water-soluble ethers which are inert to an alkaline solution such as, for example, a hydroxyethyl cellulose or sodium carboxymethyl cellulose. Additionally, film-forming materials or thickening agents whose ability to increase viscosity is substantially unaffected if left in solution for a long period of time are also disclosed to be capable of utilization. As stated, the film-forming material is preferably contained in the processing composition in such suitable quantities as to impart to the composition a viscosity in excess of 100 cps. at a temperature of approximately 24° C. and preferably in the order of 100,000 cps. to 200,000 cps. at that temperature.

In the performance of a diffusion transfer multicolor process employing film unit 10, the unit is exposed to radiation, actinic to photosensitive laminate 13, incident on the laminate's exposure surface, as illustrated in FIG. 3.

Subsequent to exposure, as illustrated by FIGS. 2 and 4, film unit 10 is processed by being passed through opposed suitably gapped rolls 35 in order to apply compressive pressure to frangible container 11 and to effect rupture of longitudinal seal 30 and distribution of alkaline processing composition 12, possessing inorganic light-reflecting pigment and optical filter agent at a pH above the pKa of the filter agent and a pH at which the cyan, magenta and yellow dye developers are soluble and diffusible as a function of the point-to-point degree of exposure of red-sensitive silver iodochlorobromide, iodochloride and/or iodobromide emulsion layer 16, green-sensitive silver iodochlorobromide, iodochloride and/or iodobromide emulsion layer 19 and blue-sensitive silver iodochlorobromide, iodochloride and/or iodobromide emulsion layer 22, respectively, intermediate image-receiving layer 24 and auxiliary layer 23.

Alkaline processing composition 12 permeates emulsion layers 16, 19 and 22 to initiate development of the latent images contained in the respective emulsions. The cyan, magenta and yellow dye developers, of layers 15, 18 and 21, are immobilized, as a function of the development of their respective associated silver iodochlorobromide, iodochloride and/or iodobromide emulsions, preferably substantially as a result of their conversion from the reduced form to their relatively insoluble and nondiffusible oxidized form, thereby providing imagewise distributions of mobile, soluble and diffusible cyan, magenta and yellow dye developer, as a function of the point-to-point degree of their associated emulsions' exposure. permeable least part of the imagewise distributions of mobile cyan, magenta and yellow dye developer transfers, by diffusion, to dyeable polymeric layer 24 to provide a multicolor dye transfer image to that layer which is viewable against the background provided by the reflecting pigment present in processing composition residuum 12 masking cyan, magenta and yellow dye developer remaining associated with blue-sensitive emulsion layer 22, green-sensitive emulsion layer 19 and red-sensitive emulsion layer 16. Subsequent to substantial transfer image formation, a sufficient portion of the ions comprising aqueous alkaline processing composition 12 transfer, by diffusion, through permeable polymeric reception layer 24, permeable spacer layer 25 to polymeric neutralizing layer 26 whereby the environmental pH of the system decreases as a function of neutralization to a pH at which the cyan, magenta and yellow dye developers, in the reduced form, are substantially nondiffusible to thereby provide a stable multicolor dye transfer image and discharge of the pH-sensitive optical filter agent by reduction of the pH substantially below the pKa of such agent to thereby provide maximum reflectivity in terms of the pigment concentration present.

The alkaline solution component of the processing composition, positioned intermediate the photosensitive element and the image-receiving layer, thus permeates the emulsions to initiate development of the latent images contained therein. The respective associated dye developers are mobilized in unexposed areas as a consequence of the development of the latent images. This mobilization is apparently, at least in part, due to a change in the solubility characteristics of dye developer upon oxidation and especially as regards its solubility in alkaline solutions. It may also be due in part to a tanning effect on the emulsion by oxidized developing agent, and in part to a localized exhaustion of alkali as a result of development. In unexposed and partially exposed areas of the emulsions, the associated dye developer is diffusible and thus provides an imagewise distribution of unoxidized dye developer dissolved in the liquid processing composition, as a function of the point-to-point degree of exposure of the silver iodochlorobromide, iodochloride and/or iodobromide emulsion. At least part of this imagewise distribution of unoxidized dye developer is transferred, by imbibition, to a superposed image-receiving layer or element, said transfer substantially excluding oxidized dye developer. The image-receiving element receives a depthwise diffusion, from the developed emulsion, of unoxidized dye developer without appreciably disturbing the imagewise distribution thereof to provide the reversed or positive color image of the developed image.

Subsequent to distribution of processing composition 12, container 11 may be manually dissociated from the remainder of the film unit, as described above, to provide the product illustrated in FIG. 6.

The present invention will be further illustrated and detailed in conjunction with the followng illustrative constructions which set out representative embodiments and photographic utilization of the novel photographic film units of this invention, which, however, are not limited to the details therein set forth and are intended to be illustrative only.

Film units similar to that shown in the drawings may be prepared, for example, by coating, in succession, on a 5 mil. opaque polyester film base, the following layers:

1. a layer of the cyan dye developer

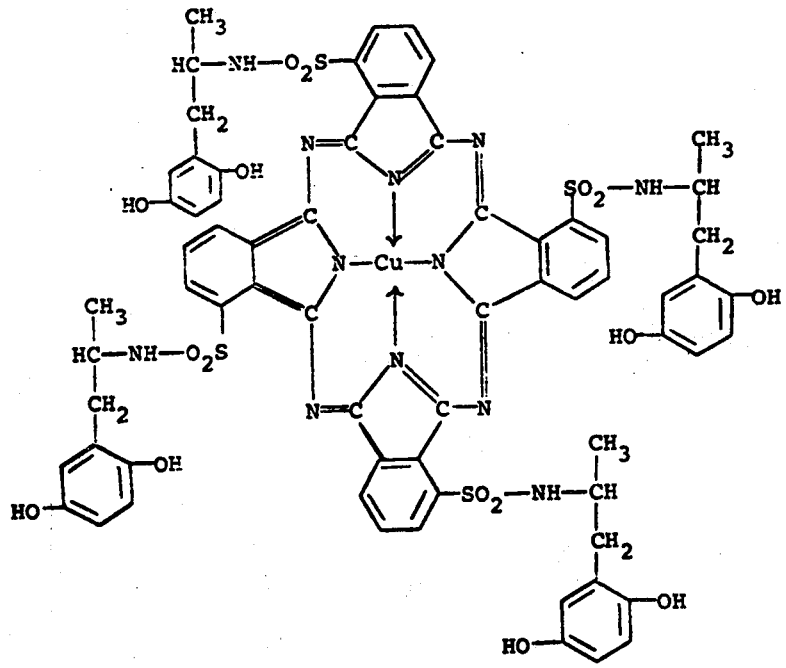

dispersed in gelatin and coated at a coverage of about 98 mgs./ft.$^2$ of dye and about 92 mgs./ft.$^2$ of gelatin;

2. a red-sensitive gelatino-silver iodobromide emulsion > 80%, by weight, of the silver iodobromide grains of which are within ±25%, by weight, of the emulsion's mean iodide concentration coated at a coverage of about 140 mgs./ft.$^2$ of silver and about 27 mgs./ft.$^2$ of gelatin;

3. a layer of butyl acrylate/diacetone acrylamide/-styrene/methacrylic acid (60/30/4/6) and polyacrylamide coated in a ratio of about 29:1, respectively, at a coverage of about 80 mgs./ft.$^2$;

4. a layer of the magenta dye developer

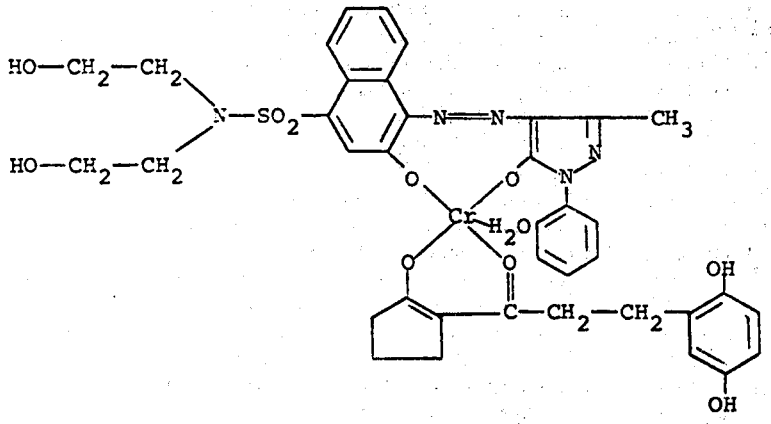

dispersed in gelatin and coated at a coverage of about 71 mgs./ft.$^2$ of dye and about 50 mgs./ft.$^2$ of gelatin;

5. a green-sensitive gelatino-silver iodobromide emulsion > 80%, by weight, of the silver iodobromide grains of which are within ± 25%, by weight of the emulsion's mean iodide concentration coated at a coverage of about 80 mgs./ft.$^2$ of silver and 40 mgs./ft.$^2$ of gelatin;

6. a layer comprising butyl acrylate/diacetone acrylamide/styrene/methacrylic acid (60/30/4/6 )and polyacrylamide coated in a ratio of about 29:4, respectively, at a coverage of about 60 mgs./ft.$^2$;

7. a layer of the yellow dye developer

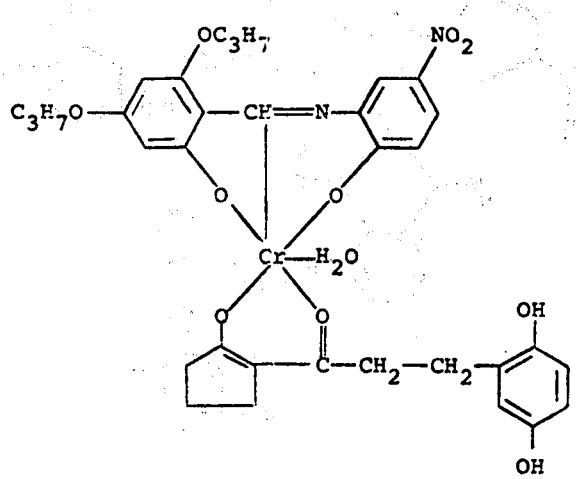

and the auxiliary developer 4'-methylphenyl hydroquinone dispersed in gelatin and coated at a coverage of about 81 mgs./ft.$^2$ of dye, about 15 mgs./ft.$^2$ of auxiliary developer and 54 mgs./ft.$^2$ of gelatin;

8. a blue-sensitive gelatino-silver iodobromide emulsion > 80%, by weight, of the silver iodobromide grains of which are within ±25%, by weight, of the emulsion's mean iodide concentration coated at a coverage of about 65 mgs./ft.$^2$ of silver and about 33 mgs./ft.$^2$ of gelatin; and 9. a layer of gelatin coated at a coverage of about 45 mgs./ft.$^2$ of gelatin.

A transparent 5 mil. polyester film base may be prepared as specifically set forth above.

The two components thus prepared may then be taped together in laminate form, at their respective edges, by means of a pressure-sensitive binding tape extending around, in contact with, and over the edges of the resultant laminate.

A rupturable container comprising a outer layer of lead foil and an inner liner or layer of polyvinyl chloride retaining an aqueous alkaline processing solution such as that specifically detailed above may then be fixedly mounted on the leading edge of each of the laminates, by pressure-sensitive tapes interconnecting the respective containers and laminates, such that, upon application of compressive pressure to a container, its contents may be distributed, upon rupture of the container's marginal seal, between the polymeric image-receiving layer and next adjacent gelatin layer.

The photosensitive composite film units may be exposed through radiation incident on the transparent polyester film base and processed by passage of the exposed film units through appropriate pressure-applying members, such as suitably gapped, opposed rolls, to effect rupture of the container and distribution of its contents. Subsequent to processing, the multicolor dye transfer image formation may be viewed through the transparent polyester layer against the titanium dioxide background provided by distribution of the pigment containing processing composition between Layer 9 and the polymeric image-receiving layer.

Film units, fabricated essentially as denoted above, may be processed in the stated manner, at processing temperatures of from about 100° to 40° F., in combination with appropriate control film units, of the same general structure, which specifically comprised conventional blue-, green- and red-sensitive gelatino silver iodobromide emulsions and the units, both the control and test units, may be exposed to a conventional step wedge to provide graphic illustration of the characteristic curves of the respective dye transfer images forming the multicolor dye positive images. Specifically, the detailed characteristic curves may be determined by plotting the density of the respective images to red, green and blue light, as a function of the log exposure of the photosensitive element, e.g., the characteristic cyan, magenta and yellow transfer image dye curves (read to red, green and blue reflected light) of the test and control film units.

As may be noted from examination of characteristic curves prepared in the stated manner, the previously described improvement in dye transfer image control and processing temperature latitude may be directly achieved by means of the present invention.

The test gelatino silver iodobromide emulsions employed will possess the halide distribution gradient detailed hereinbefore and may be prepared as previously detailed and appropriately sensitized spectrally by addition of an effective concentration of one or more optical sensitizing dyes dispersed in an appropriate carrier solvent.

By addition of an effective concentration of

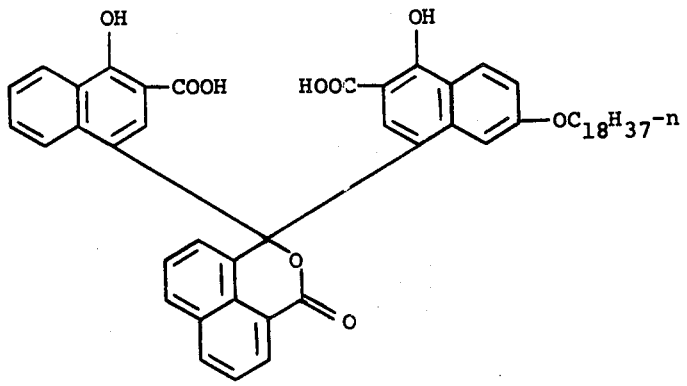

and

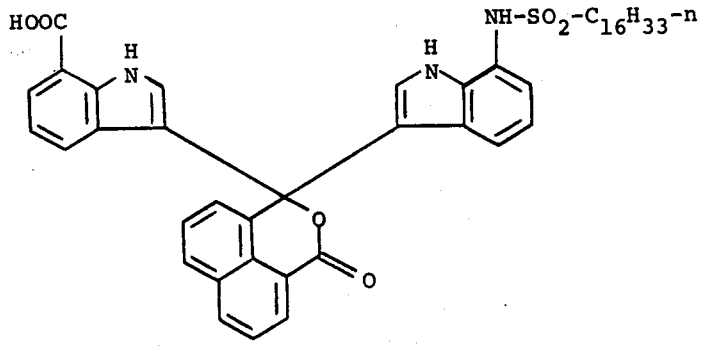

to the processing composition, image formation may be immediately viewed upon distribution of the processing composition by reason of the protection against incident radiation afforded the photosensitive silver halide emulsion layers by the composition's optical transmission density of > about 6.0 density units and against the titanium dioxide's effective reflective background afforded by reason of the composition possessing an optical reflection density of < about 1.0 density units.

The pH and solvent concentration of the alkaline processing solution initially employed will possess a pH above the pKa of the optical filter agents where the latter are employed, that is, the pH at which about 50% of the agents are present as the lesser absorbing species and about 50% are present as the greater absorbing species, preferably a pKa of > about 11 and most preferably > about 12 and a pH at which the dye developers employed are soluble and diffusible. Although it has been found that the specific pH to be employed may be readily determined empirically for any dye developer and optical filter agent, or group of dye developers and filter agents, most particularly desirable dye developers are soluble at pH's above 9 and relatively insoluble at pH's below 9, in reduced form, and relatively insoluble at substantially any alkaline pH, in oxidized form, and the system can be readily balanced accordingly for such dye developers. In addition, although as previously noted, the processing composition, in the preferred embodiment, will include the stated film-forming viscosity-increasing agent, or agents, to facilitate spreading of the composition and to provide maintenance of the spread composition as a structurally stable layer of the laminate, subsequent to distribution, it is not necessary that such agent be employed as a component of the composition.

Neutralizing means, for example, a polymeric acid layer of the type discussed above may be incorporated, as stated, in the film unit of the present invention, to provide reduction of the alkalinity of the processing solution from a pH above the pKa of the optical filter agent selected at which the dyes are soluble to a pH below the pKa of the agent at which the dyes are substantially nondiffusible, in order to advantageously further stabilize and optimize reflectivity of the dye transfer image. In such instance, the neutralizing layer may comprise particulate acid reacting reagent disposed within the film unit or a polymeric acid layer, for example, a polymeric acid layer approximating 0.3 to 1.5 mils. in thickness, positioned intermediate the transparent support and image-receiving layer, and/or the opaque support and next adjacent emulsion/dye unit layer, and the film unit may also contain a polymeric spacer or barrier layer, for example, approximating 0.1 to 0.7 mil. in thickness, next adjacent the polymeric acid layer, opposite the respective support layer, as previously described.

Specifically, the film units may employ the presence of a polymeric acid layer such as, for example, of the type set forth in U.S. Pat. No. 3,362,819 which, most preferably, includes the presence of an inert timing or spacer layer intermediate the polymeric acid layer carried on a support and the image-receiving layer.

As set forth in the last-mentioned patent, the polymeric acid layer may comprise polymers which contain acid groups, such as carboxylic acid and sulfonic acid groups, which are capable of forming salts with alkali metals, such as sodium, potassium etc., or with organic bases, particularly quaternary ammonium bases, such as tetramethyl ammonium hydroxide, or potentially acid-yielding groups, such as anhydrides or lactones, or other groups which are capable of reacting with bases to capture and retain them. The acid-reacting group is, of course, retained in the polymer layer. In the preferred embodiments disclosed, the polymer contains free carboxyl groups and the transfer processing composition employed contains a large concentration of sodium and/or potassium ions. The acid polymers stated to be most useful are characterized by containing free carboxylic groups, being insoluble in water in the free acid form, and by forming water-soluble and/or potassium salts. One may also employ polymers containing carboxylic acid anhydride groups, at least some of which preferably have been converted to free carboxyl groups prior to imbibition. While the most readily available polymeric acids are derivatives of celluslose or of vinyl polymers, polymeric acids from other classes of polymers may be used. As examples of specific polymeric acids set forth in the application, mention may be made of dibasic acid half-ester derivatives of cellulose which derivatives contain free carboxyl groups, e.g., cellulose acetate hydrogen phthalate, cellulose acetate hydrogen glutarate, cellulose acetate hydrogen succinate, ethyl cellulose hydrogen succinate, ethyl cellulose acetate hydrogen succinate, cellulose acetate hydrogen succinate hydrogen phthalate; ether and ester derivatives or cellulose modified with sulfoanhydrides, e.g., with ortho-sulfobenzoic anhydride; polystyrene sulfonic acid; carboxymethyl cellulose; polyvinyl hydrogen phthalate; polyvinyl acetate hydrogen phthalate; polyacrylic acid; acetals of polyvinyl alcohol with carboxy or sulfo substituted aldehydes, e.g., o-, m-, or p-benzaldehyde sulfonic acid or carboxylic acid; partial esters of ethylene/maleic anhydride copolymers; partial esters of methyl-vinyl ether/maleic anhydride copolymers; etc.

As previously noted, the pH of the processing composition preferably is of the order of at least 12 to 14 and the pKa of the selected optical filter agents will accordingly preferably be in the order of 13 or greater. The polymer layer is disclosed to contain at least sufficient acid groups to effect a reduction in the pH of the image layer from a pH of about 12 to 14 to a pH of at least 11 or lower at the end of the imbibition period, and preferably to a pH of about 5 to 8 within a short time after imbibition, thus requiring, of course, that the action of the polymeric acid be accurately so controlled as not to interfere with either development of the negative or image transfer of unoxidized dye developers. For this reason, the pH of the image layer must be kept at a functional transfer level, for example 12 to 14 until the dye image has been formed after which the pH is reduced very rapidly to a pH below that at which dye transfer may be accomplished, for example, at least 11 and preferably about pH 9 to 10. Unoxidized dye developers containing hydroquinonyl developing radicals diffuse from the negative to the positive as the sodium or other alkali salt. The diffusion rate of such dye image-forming components thus is at least partly a function of the alkali concentration, and it is necessary that the pH of the image layer remain on the order of, for example, 12 to 14 until transfer of the necessary quantity of dye has been accomplished. The subsequent pH reduction, in addition to its desirable effect upon image light stability, serves a highly valuable photographic function by substantially terminating further dye transfer.

In order to prevent premature pH reduction during transfer processing, as evidenced, for example, by an undesired reduction in positive image density, the acid groups are disclosed to be so distributed in the polymer layer that the rate of their availability to the alkali is controllable, e.g., as a function of the rate of swelling of the polymer layer which rate in turn has a direct relationship to the diffusion rate of the alkali ions. The desired distribution of the acid groups in the polymer layer may be effected by mixing acid polymer with a polymer free of acid groups, or lower in concentration of acid groups, and compatible therewith, or by using only an acid polymer but selecting one having a relatively lower proportion of acid groups. These embodiments are illustrated, respectively, in the cited copending application, by (a) a mixture of cellulose acetate and cellulose acetate hydrogen phthalate and (b) a cellulose acetate hydrogen phthalate polymer having a much lower percentage of phthayl groups than the first-mentioned cellulose acetate hydrogen phthalate.

It is also there disclosed that the layer containing the polymeric acid may contain a water-insoluble polymer, preferably a cellulose ester, which acts to control or modulate the rate at which the alkali salt of the polymer acid is formed. As examples of cellulose esters contemplated for use, mention is made of cellulose acetate, cellulose acetate butyrate, etc. The particular polymers and combinations of polymers employed in any given embodiment are, of course, selected so as to have adequate wet and dry strength and when necessary or desirable suitable subcoats are employed to help the various polymeric layers adhere to each other during storage and use.

The inert spacer layer of the last-mentioned patent, for example, an inert spacer layer comprising polyvinyl alcohol or gelatin, acts to "time" control the pH reduction by the polymeric acid layer. This timing is disclosed to be a function of the rate at which the alkali diffuses through the inert spacer layer. It is there stated to have been found that the pH does not drop until the alkali has passed through the spacer layer, i.e., the pH is not reduced to any significant extent by the mere diffusion into the interlayer, but the pH drops quite rapidly once the alkali diffuses through the spacer layer.

As disclosed in aforementioned U.S. Pat. No. 3,362,819, the presence of an inert spacer layer was found to be effective in evening out the various reaction rates over a wide range of temperatures, for example, by preventing premature pH reduction when imbibition is effected at temperatures above room temperature, for example, at 95° to 100° F. By providing an inert spacer layer, that application discloses that the rate at which alkali is available for capture in the polymeric acid layer becomes a function of the alkali diffusion rates.

However, as disclosed in U.S. Pat. No. 3,455,686 preferably the aforementioned rate at which the cations of the alkaline processing composition, i.e., alkali ions, are available for capture in the polymeric acid layer should be decreased with increasing transfer processing temperatures in order to provide diffusion transfer color processes relatively independent of positive transfer image variations over an extended range of ambient temperatures.

Specifically, it is there stated to have been found that the diffusion rate of alkali through a permeable inert polymeric spacer layer increases with increased processing temperature to the extent, for example, that at relatively high transfer processing temperatures, that is, transfer processing temperatures above approximately 80° F., a premature decrease in the pH of the transfer processing composition occurs due, at least in part, to the rapid diffusion of alkali from the dye transfer environment and its subsequent neutralization upon contact with the polymeric acid layer. This was stated to be especially true of alkali traversing an inert spacer later possessing permeability to alkali optimized to be effective with the temperature range of optimum transfer processing. Conversely, at temperatures below the optimum transfer processing range, for example, temperatures below approximately 40° F., the last-mentioned inert spacer layer was disclosed to provide an effective diffusion barrier timewise preventing effective traverse of the inert spacer layer by alkali having temperature depressed diffusion rates and to result in maintenance of the transfer processing environment's high pH for such an extended time interval as to facilitate formation of transfer image stain and its resultant degradation of the positive transfer images' color definition.

It is further stated in the last-mentioned U.S. Pat. No. 3,455,686 to have been found, however, that if the inert spacer layer of the print-receiving element is replaced by a spacer layer which comprises a permeable polymeric layer exhibiting permeability inversely dependent on temperature, that is, a polymeric film-forming material which exhibits decreasing permeability to solubilized alkali derived cations such as alkali metal and quaternary ammonium ions under conditions of increasing temperature, that the positive transfer image defects resultant from the aforementioned overextended pH maintenance and/or premature pH reduction are obviated.

As examples of polymers which were disclosed to exhibit inverse temperature-dependent permeability to alkali, mention may be made of: hydroxypropyl polyvinyl alcohol, polyvinyl methyl ether, polyethylene oxide, polyvinyl oxazolidone, hydroxypropyl methyl cellulose, isopropyl cellulose, partial acetals of polyvinyl alcohol such as partial polyvinyl butyral, partial polyvinyl formal, partial polyvinyl acetal, partial polyvinyl propional, and the like.

The last-mentioned specified acetals of polyvinyl were stated to generally comprise saturated aliphatic hydrocarbon chains of a molecular weight of at least 1000, preferably of about 1000 to 50,000, possessing a degree of acetalation within about 10 to 30%, 10 to 30%, 20 to 80%, and 10 to 40%, of the polyvinyl alcohol's theoretical polymeric hydroxy groups, respectively, and including mixed acetals where desired.

Where desired, a mixture of the polymers may be employed, for example, a mixture of hydroxypropyl methyl cellulose and partial polyvinyl butyral.

Employment of the detailed and preferred film units of the present invention, according to the herein described color diffusion transfer process, specifically provides for the production of a highly stable transfer image accomplished, at least in part, by effectively obviating the previously discussed disadvantages of the prior art products and processes, by in process adjustment of the environmental processng composition solvent and pH concentration from a solvent and pH concentration at which dye diffusion or transfer is operative to a solvent and pH concentration at which dye transfer is inoperative subsequent to substantial transfer image formation. The stable color transfer image is obtained irrespective of the fact that the film unit is maintained as an integral laminate unit during exposure, processing, viewing, and storage of the unit. Accordingly, by means of the present invention, multicolor transfer images may be provided over an extended processing temperature range which exhibit desired maximum and minimum dye transfer image densities; yellow, magenta and cyan dye saturation; red, green and blue hues; and color separation. These unexpected advantages are in addition to the manufacturing advantages obtained by reason of the present invention's integral color transfer film unit construction and which will be readily apparent from examination of the unit's parameters, that is, for example, advantages in more efficient utilization of fabricating materials and components, enhanced simplicity of film manufacture and camera design and construction, and more simplified and effectively controlled customer utilization of the unit.

The dimensionally stable support layers referred to may comprise any of the various types of conventional opaque and transparent rigid or flexible materials possessing the requisite liquid impermeability and, preferably, the vapor transmissivity denoted above, and may comprise polymeric films of both synthetic types and those derived from naturally occurring products. Particularly suitable materials include aqueous alkaline solution impermeable, water vapor permeable flexible polymeric materials such as vapor permeable polymeric films derived from ethylene glycol terephthalic acid, vinyl chloride polymers; polyvinyl acetate; polyamides; polymethacrylic acid methyl and ethyl esters; cellulose derivatives such as cellulose, acetate, triacetate, nitrate, propionate, butyrate, acetate-propionate, or acetate-butyrate; alkaline solution impermeable, water vapor permeable papers; crosslinked polyvinyl alcohol; regenerated cellulose; and the like.

As examples of materials, for use as the image-receiving layer, mention may be made of solution dyeable polymers such as nylon as, for example, N-methoxymethyl polyhexamethylene adipamide; partially hydrolyzed polyvinyl acetate; polyvinyl alcohol with or without plasticizers; cellulose acetate with filler as, for example, one-half cellulose acetate and one-half oleic acid; gelatin; and other materials of a similar nature. Preferred materials comprise polyvinyl alcohol or gelatin containing a dye mordant such as poly-4-vinylpyridine, as disclosed in U.S. Pat. No. 3,148,061, issued Sept. 8, 1964.

It will be noted that the liquid processing composition employed may contain an auxiliary or accelerating developing agent, such as p-methylaminophenol, 2,4-diaminophenol, p-benzylaminophenyl, hydroquinone, toluhydroquinone, phenylhydroquinone, 4'-methylphenylhydroquinone, etc. It is also contemplated to employ a plurality of auxiliary or accelerating developing agents, such as a 3-pyrazolidone developing agent and a benzenoid developing agent, as disclosed in U.S. Pat. No. 3,039,869, issued June 19, 1962. As examples of suitable combinations of auxiliary developing agents, mention may be made of 1-phenyl-3-pyrazolidone in combination with p-benzylaminophenol and 1-phenyl-3-pyrazolidone in combination with 2,5-bis-ethylenimino-hydroquinone. Such auxiliary developing agents may be employed in the liquid processing composition or they may be initially incorporated, at least in part, in any one or more of the silver halide emulsion strata, the strata containing the dye developers, the interlayers, the overcoat layer, the image-receiving layer, or in any other auxiliary layer, or layers, of the film unit. It may be noted that at least a portion of the dye developer oxidized during development may be oxidized and immobilized as a result of a reaction, e.g., an energy-transfer reaction, with the oxidation product of an oxidized auxiliary developing agent, the latter developing agent being oxidized by the development of exposed silver halide. Such a reaction of oxidized developing agent with unoxidized dye developer would regenerate the auxiliary developing agent for further reaction with the exposed silver halide.

In addition, development may be effected in the presence of an onium compound, particularly a quaternary ammonium compound, in accordance with the processes disclosed in U.S. Pat. No. 3,173,786, issued Mar. 16, 1965.

It will be apparent that the relative proportions of the agents of the diffusion transfer processing composition may be altered to suit the requirements of the operator. Thus, it is within the scope of this invention to modify the herein described developing compositions by the substitution of preservatives, alkalies, etc., other than those specifically mentioned, provided that the pH of the composition is initially at the first pH and solvent concentration required. When desirable, it is also contemplated to include, in the developing composition, components such as restrainers, accelerators, etc. Similarly, the concentration of various components may be varied over a wide range and when desirable adaptable components may be disposed in the photosensitive element, prior to exposure, in a separate permeable layer of the photosensitive element and/or in the photosensitive emulsion.

In all examples of this specification, percentages of components are given by weight unless otherwise indicated.

An extensive compilation of specific dye developers particularly adapted for employment in photographic diffusion transfer processes is set forth in aforementioned U.S. Pat. No. 2,983,606 and in the various copending U.S. applications referred to in that patent, especially in the table of U.S. applications incorporated by reference into the patent as detailed in column 27. As examples of additional U.S. patents detailing specific dye developers for photographic transfer process use, mention may also be made of U.S. Pat. Nos. 2,983,605; 2,992,106; 3,047,386; 3,076,808; 3,076,820; 3,077,402; 3,126,280; 3,131,061; 3,134,762; 3,134,765; 3,135,604; 3,135,605; 3,135,606; 3,135,734; 3,141,772; 3,142,565; and the like.

In addition to conventional techniques for the direct dispersion of a particulate solid material in a polymeric, or colloidal, matrix such as ball-milling and the like techniques, the preparation of the dye developer dispersion may also be obtained by dissolving the dye in an appropriate solvent, or mixture of solvents, and the resultant solution distributed in the polymeric binder, with optional subsequent removal of the solvent, or solvents, employed, as, for example, by vaporization where the selected solvent, or solvents, possesses a sufficiently low boiling point or washing where the selected solvent, or solvents, possesses a sufficiently high differential solubility in the wash medium, for example, water, when measured against the solubility of the remaining composition components, and/or obtained by dissolving both the polymeric binder and dye in a common solvent.

For further detailed treatment of solvent distribution systems of the types referred to above, and for an extensive compilation of the conventional solvents traditonally employed in the art to effect distribution of photographic color-providing materials in polymeric binders, specifically for the formation component layers of photographic film units, reference may be made to U.S. Pat. Nos. 2,269,158; 2,322,027; 2,304,939; 2,304,940; 2,801,171; and the like.

Although the invention has been discussed in detail throughout employing dye developers, the preferred image-providing materials, it will be readily recognized that other, less preferred, diffusion transfer process dye image-providing materials may be substituted in replacement of the preferred dye developers in the practice of the invention. For example, there may be employed dye image-forming materials such as those disclosed in U.S. Pat. Nos. 2,647,049; 2,661,293; 2,698,244; 2,698,798; 2,802,735; 3,148,062; 3,227,550; 3,227,551; 3,227,552; 3,227,554; 3,243,294; 3,330,655; 3,347,671; 3,352,672; 3,364,022; 3,443,939; 3,443,940; 3,443,941; 3,443,943; etc., wherein color diffusion transfer processes are described which employ color coupling techniques comprising, at least in part, reacting one or more color developing agents and one or more color formers of couplers to provide a dye transfer image to a superposed image-receiving layer and those disclosed in U.S. Pat. Nos. 2,774,668 and 3,087,817, wherein color diffusion transfer processes are described which employ the imagewise differential transfer of complete dyes by the mechanisms therein described to provide a transfer dye image to a contiguous image-receiving layer, and thus including the employment of image-providing materials in whole or in part initially insoluble or nondiffusible as disposed in the film unit which diffuse during processing as a direct or indirect function of exposure.

Although the preceding description of the invention has been couched in terms of the preferred photosensitive component construction wherein at least two selectively sensitized photosensitive strata are in contiguous coplanar relationship and, specifically, in terms of the preferred tripack type structure comprising a red-sensitive silver halide emulsion stratum, a green-sensitive silver halide emulsion stratum and a blue-sensitive silver halide emulsion stratum having associated therewith, respectively a cyan dye developer, a magenta dye developer and a yellow dye developer, the photosensitive component of the film unit may comprise at least two sets of selectively sensitized minute photosensitive elements arranged in the form of a photosensitive screen wherein each of the minute photosensitive elements has associated therewith, for example, an appropriate dye developer in or behind its respective silver halide emulsion portion. In general, a suitable photosensitive screen will comprise minute red-sensitized emulsion elements, minute green-sensitized emulsion elements and minute blue-sensitized emulsion elements arranged in side-by-side relationship in a screen pattern and having associated therewith, respectively, a cyan, a magenta and a yellow dye developer.

The present invention also includes the employment of a black dye developer and the use of a mixture of dye developers adapted to provide a black-and-white transfer image, for example, the employment of dye developers of the three subtractive colors in an appropriate mixture in which the quantities of the dye developers are proportioned such that the colors combine to provide black.

Where in the specification, the expression "positive image" has been used, this expression should not be interpreted in a restrictive sense since it is used primarily for purposes of illustration, in that it defines the image produced on the image-carrying layer as being reversed, in the positive-negative sense, with respect to the image in the photosensitive emulsion layers. As an example of an alternative meaning for "positive image", assume that the photosensitive element is exposed to actinic light through a negative transparency. In this case, the latent image in the photosensitive emulsion layers will be a positive and the dye image produced on the image-carrying layer will be a negative. The expression "positive image" is intended to cover such an image produced on the image-carrying layer.

It will be recognized that, by reason of the preferred film unit's structural parameters, the transfer image formed upon directed exposure of the film unit to a selected subject and processing, will be a geometrically reversed image of the subject. Accordingly, to provide transfer image formation geometrically nonreversed, exposure of such film unit should be accomplished through an image-reversing optical system such a camera possessing an image-reversing optical system.

In addition to the described essential layers, it will be recognized that the film unit may also contain one or more subcoats or layers, which, in turn, may contain one or more additives such as plasticizers, intermediate essential layers for the purpose, for example, of improving adhesion, and that any one or more of the described layers may comprise a composite of two or more strata of the same, or different, components and which may be contiguous, or separated from, each other, for example, two or more neutralizing layers or the like, one of which may be disposed intermediate the cyan dye image-forming component retaining layer and the dimensionally stable opaque layer.

Since certain changes may be made in the above product and process without departing from the scope of the invention herein involved, it is intended that all matter contained in the above description or shown in the accompanying drawings shall be interpreted as illustrative and not in a limiting sense.

What is claimed is:

1. A photographic diffusion transfer color process film unit which comprises a plurality of layers including a photosensitive layer comprising a particulate dispersion of polydisperse photosensitive silver iodochlorobromide polydisperse, silver iodochloride and/or polydisperse silver iodobromide grains which possess in terms of the iodide thereof a mean iodide concentration within the range of about 0.5 to 15 mole %, and in which dispersion not in excess of about 20%, by weight, of the silver iodochlorobromide, silver iodochloride or silver iodobromide grains deviate from the mean iodide concentration by in excess of about ± 25%, by weight, iodide, having associated therewith diffusion transfer process dye image-forming material and a layer adapted to receive diffusion transfer process dye image-forming material diffusing thereto as a function of the point-to-point degree of said photosensitive layer's exposure to incident actinic radiation.

2. A photographic diffusion transfer color process film unit as defined in claim 1 wherein said polydisperse photosensitive silver iodochlorobromide, silver iodochloride and silver iodobromide grain dispersion possess a mean grain size within the range of about 0.3 to 3.0 $\mu$.

3. A photographic diffusion transfer color process film unit as defined in claim 1 wherein said photosensitive layer comprises a plurality of said photosensitive silver iodochlorobromide, silver iodochloride or silver iodobromide dispersions.

4. A photographic diffusion transfer color process film unit as defined in claim 3 wherein each of said dispersions comprises a silver iodobromide dispersion.

5. A photographic diffusion transfer color process film unit as defined in claim 1 including opacifying agent, in a quantity sufficient to mask dye image-forming material associated with said photosensitive silver halide layer, adapted to be disposed intermediate said photosensitive silver halide layer and said layer adapted to receive dye image-forming material diffusing thereto.

6. A photographic diffusion transfer color process film unit as defined in claim 1 including means for contacting said photosensitive silver halide layer with a processing composition possessing a pH at which said dye image-forming material is soluble and diffusible as a function of the point-to-point degree of said photosensitive layer's exposure to incident actinic radiation.

7. A photographic diffusion transfer color process film unit as defined in claim 6 including means for converting the pH of the film unit from said pH at which said dye image-forming material is soluble and diffusible as a function of said photosensitive layer's exposure to incident actinic radiation to a second pH at which said dye image-forming material is substantially nondiffusible, subsequent to substantial diffusion of solubilized dye image-forming material to said layer adapted to receive said dye image-forming material diffusing thereto.

8. A photographic diffusion transfer color process film unit as defined in claim 6 wherein said means for contacting said photosensitive layer with said processing composition comprises a rupturable container retaining said processing composition positioned extending transverse and edge of the film unit to effect, upon application of compressive pressure to said container, discharge of said container's processing composition contents into contact with said photosensitive silver halide layer.

9. A photographic diffusion transfer color process film unit as defined in claim 8 wherein said rupturable container retaining said processing composition is adapted, upon application of compressive pressure to the container, to discharge the container's processing composition contents intermediate said photosensitive layer and the layer adapted to receive dye image-forming material diffusing thereto.

10. A photographic diffusion transfer color process film unit as defined in claim 9 wherein said processing composition includes opacifying agent in a quantity sufficient to mask dye image-forming material associated with said photosensitive layer.

11. A photographic diffusion transfer color process film unit as defined in claim 10 including a dimensionally stable opaque layer positioned contiquous the surface of said photosensitive layer opposite said layer adapted to receive dye image-forming material diffusing thereto.

12. A photographic diffusion transfer color process film unit as defined in claim 11 including a dimensionally stable transparent layer positioned contiguous the surface of said layer adapted to receive dye image-forming material diffusing thereto opposite said photosensitive layer.

13. A photographic diffusion transfer color process film unit as defined in claim 1 wherein said dye image-forming material is a dye which is a silver halide developing agent.

14. A photographic diffusion transfer color process film unit as defined in claim 1 including a dimensionally stable layer positioned contiguous the surface of said photosensitive silver halide layer opposite said layer adapted to receive dye image-forming material diffusing thereto and additionally including at least two selectively sensitized silver halide layers at least one of said selectively sensitized layers comprising a particulate dispersion of photosensitive silver iodochlorobromide, silver iodochloride or silver iodobromide grains which contain in terms of the iodide thereof a mean iodide concentration within the range of about 0.5 to 15 mole %, and in which dispersion not in excess of about 20%, by weight, of the grains deviate from the mean iodide concentration by in excess of about ± 25%, by weight, iodide, having a diffusion transfer process dye image-forming material associated therewith.

15. A photographic diffusion transfer color process film unit as defined in claim 14 wherein each of the selectively sensitized silver halide layers possesses predominant spectral sensitivity to separate regions of the spectrum and the dye image-forming material associated with each of said silver halide layers possesses a spectral absorption range subsequent to processing substantially complementary to the predominant sensitivity range of its associated silver halide layer.

16. A photographic diffusion transfer color process film unit as defined in claim 15 wherein said selectively sensitized silver iodochlorobromide, iodochloride or iodobromide layer comprises photosensitive silver iodochlorobromide, iodochloride or iodobromide grains possessing a mean grain size within the range of about 0.3 to 3.0 $\mu$.

17. A photographic diffusion transfer color process film unit as defined in claim 16 which comprises, in combination:

a photosensitive element including a composite structure containing, as essential layers, a dimensionally stable opaque layer; at least two selectively sensitized silver halide emulsion layers possessing predominant spectral sensitivity to separate regions of the visible electromagnetic spectrum, said silver halide emulsion layers comprising a particulate dispersion of photosensitive silver iodochlorobromide, iodochloride or iodobromide grains which contain in terms of the iodide thereof a mean iodide concentration within the range of about 0.5 to 15 mole %, and in which dispersion not in excess of about 20%, by weight, of the grains deviate from the mean iodide concentration by in excess of about ± 25%, by weight, iodide, and which dispersion possesses a mean grain size within the range of about 0.3 to 3.0 $\mu$, and said emulsion layers have associated therewith a dye which is a silver halide developing agent and is soluble and diffusible, in alkaline processing composition, at a first pH, possessing a spectral absorption range subsequent to processing substantially complementary to the predominant sensitivity range of its associated emulsion layer; an alkaline solution permeable and dyeable polymeric layer; a polymeric layer possessing acid capacity effective subsequent to substantial dye transfer image formation in said dyeable polymeric layer to reduce alkaline processing composition possessing said first pH at which said dyes are soluble and diffusible to a second pH at which said dyes are substantially nondiffusible; a dimensionally stable transparent layer; and means securing the layers in substantially fixed relationship; and a rupturable container retaining an alkaline processing composition possessing said first pH at which said dyes are soluble and diffusible and opacifying agent in a quantity sufficient to mask dye associated with said selectively sensitized silver halide emulsion layers, said rupturable container positioned and extending transverse an edge of the photosensitive element to effect unidirectional discharge of the container's alkaline processing composition intermediate the dyeable polymeric layer and the selectively sensitized silver halide emulsion layer next adjacent thereto.

18. A photographic diffusion transfer color process film unit as defined in claim 15 adapted to be processed by passage of said unit between a pair of juxtaposed pressure-applying members and which comprises, in combination:

a photosensitive element including a composite structure containing, as essential layers, in sequence, a dimensionally stable alkaline solution impermeable opaque layer; a red-sensitive silver halide emulsion layer having associated therewith cyan dye; a green-sensitive silver halide emulsion layer having associated therewith magenta dye; a blue-sensitive silver halide emulsion layer having associated therewith a yellow dye, at least one of said red-, green- and blue-sensitive silver halide emulsion layers comprising a particulate dispersion of photosensitive silver iodochlorobromide, iodochloride or iodobromide grains which contain in terms of the iodide thereof a mean iodide concentration within the range of about 0.5 to 15 mole %, and in which dispersion not in excess of about 20%, by weight, of the grains deviate from the mean iodide concentration by in excess of about ± 25%, by weight, iodide, and said cyan, magenta and yellow dyes are silver halide developing agents soluble and diffusible, in alkaline processing composition, at a first pH; an alkaline solution permeable and dyeable polymeric layer; a polymeric layer containing sufficient acidifying capacity to effect reduction of a processing composition having said first pH at which said cyan, magenta and yellow dyes are soluble and diffusible to a second pH at which said cyan, magenta and yellow dyes are substantially nondiffusible; a dimensionally stable alkaline solution impermeable transparent layer; and means securing said layers substantially in fixed relationship; and a rupturable container retaining an aqueous alkaline processing composition having said first pH at which said cyan, magenta and yellow dyes are soluble and diffusible and opacifying agent in a quantity sufficient to mask, upon distribution of the aqueous alkaline processing composition as a layer, intermediate the dyeable polymeric layer and said blue-sensitive silver halide emulsion layer, cyan, magenta and yellow dye associated with said red-, green-, and blue-sensitive emulsion layers, said container fixedly positioned and extending transverse an edge of the photosensitive element to effect, upon application of compressive force to said container, unidirectional discharge of the container's aqueous alkaline processing composition contents intermediate said dyeable polymeric layer and said blue-sensitive silver halide emulsion layer.

19. A process of forming transfer images in color which comprises, in combination, the steps of:

a. exposing a photographic film unit which includes, in combination, a photosensitive element containing a photosensitive silver halide layer comprising a particulate dispersion of polydisperse photosensitive silver iodochlorobromide, polydisperse silver iodochloride and/or polydisperse silver iodobromide grains which contain in terms of the iodide thereof a mean iodide concentration within the range of about 0.5 to 15 mole %, and in which dispersion not in excess of about 20%, by weight, of the grains deviate from the mean iodide concentration by in excess of about ± 25%, by weight, iodide, having associated therewith a dye image-providing material which is diffusible during processing as a function of the point-to-point degree of the photosensitive layer's exposure to incident actinic radiation;

b. contacting said photosensitive silver halide emulsion with a processing composition;

c. effecting thereby development of said photoexposed silver halide layer;

d. forming thereby an imagewise distribution of diffusible dye image-providing material, as a function of the point-to-point degree of said silver halide layer's exposure incident actinic radiation; and e. transferring by diffusion at least a portion of said imagewise distribution of said diffusible dye image-providing material to an image-receiving element dyeable by said dye image-providing material to provide thereto a dye image in terms of said imagewise distribution.

20. A process of forming transfer images in color as defined in claim 19 wherein said photosensitive silver iodochlorobromide, silver iodochloride or silver iodobromide grains possess a mean grain size within the range of about 0.3 to 3.0 $\mu$.

21. A process of forming transfer images in color as defined in claim 19 wherein said dye image-providing material is a dye which is a silver halide developing agent.

22. A process of forming transfer images in color as defined in claim 19 wherein said photosensitive element comprises in contiguous relationship at least two selectively sensitized silver halide layers at least one of said selectively sensitized layers comprising a particulate dispersion of photosensitive silver iodochlorobromide, silver iodochloride or silver iodobromide grains which contain in terms of the iodide thereof a mean iodide concentration within the range of about 0.5 to 15 mole %, and in which dispersion not in excess of about 20%, by weight, of the grains deviate from the mean iodide concentration by in excess of about ± 25%, by weight, iodide, having associated therewith a dye image-providing material which diffusible during processing as a function of the point-to-point degree of the photoexposure of its associated silver halide layer.

23. A process of forming transfer images in color as defined in claim 22 wherein said selectively sensitized silver halide layers possess predominant spectral sensitivity to separate regions of the visible spectrum and dye image-providing material associated with each of said emulsion layers provides a dye possessing subsequent to processing a spectral absorption range substantially complementary to the predominant sensitivity range of its associated emulsion layer.

24. A process of forming transfer images in color as defined in claim 23 wherein said photosensitive element contains, as essential layers, in sequence, a support layer; a red-sensitive silver halide emulsion layer having associated therewith cyan dye; a green-sensitive silver halide emulsion layer having associated therewith magenta dye; a blue-sensitive silver halide emulsion layer having associated therewith yellow dye, each of said cyan, magenta and yellow dyes being a silver halide developing agent and at least one of said red-, green- and blue-sensitive silver halide emulsion layers comprising a particulate dispersion of photosensitive silver iodochlorobromide, iodochloride or iodobromide grains which contain in terms of the iodide thereof a mean iodide concentration within the range of about 0.5 to 15 mole %, and in which dispersion not in excess of about 20%, by weight, of the grains deviate from the mean iodide concentration by in excess of about ±25%, by weight, iodide, and possess a mean particle size within the range of about 0.3 to 3.0 $\mu$, and wherein said image-receiving element contains, as essential layers, in sequence, an alkaline solution permeable polymeric layer dyeable by said dyes; and a support layer.

25. A process of forming transfer images in color as defined in claim 24 wherein said film unit includes means for converting the pH of the film unit from a first processing pH at which said cyan, magenta and yellow dyes are diffusible to a second pH at which said dyes are substantially nondiffusible and including the step of converting said film unit from said first pH to said second pH subsequent to substantial imagewise transfer of dye from said photosensitive element to said image-receiving element.

* * * * *